US006702033B1

(12) United States Patent
Mitchell et al.

(10) Patent No.: US 6,702,033 B1
(45) Date of Patent: Mar. 9, 2004

(54) HYBRID FIRE EXTINGUISHER

(75) Inventors: Robert M. Mitchell, North Bend, WA (US); Nicholas R. Arnot, Woodinville, WA (US); George J. Callis, Bothell, WA (US)

(73) Assignee: Aerojet-General Corporation, Redmond, WA (US)

( * ) Notice: Subject to any disclaimer, the term of this patent is extended or adjusted under 35 U.S.C. 154(b) by 0 days.

(21) Appl. No.: 09/937,868

(22) PCT Filed: Mar. 7, 2000

(86) PCT No.: PCT/US00/05953

§ 371 (c)(1),
(2), (4) Date: Nov. 29, 2001

(87) PCT Pub. No.: WO00/57959

PCT Pub. Date: Oct. 5, 2000

Related U.S. Application Data

(60) Provisional application No. 60/127,084, filed on Mar. 31, 1999.

(51) Int. Cl.[7] ..... A62C 35/58
(52) U.S. Cl. ..... 169/85; 169/9
(58) Field of Search ..... 169/9, 19, 26, 169/85, 87, 89, 56

(56) References Cited

U.S. PATENT DOCUMENTS

| | | | | |
|---|---|---|---|---|
| 2,530,633 A | | 11/1950 | Scholz | 169/26 |
| 2,557,957 A | | 6/1951 | Ferguson | 169/31 |
| 2,838,122 A | | 6/1958 | Hutchinson | 169/1 |
| 3,088,522 A | | 5/1963 | Zellner | 169/31 |
| 3,228,474 A | | 1/1966 | Huthsing, Jr. | 169/31 |
| 3,441,087 A | * | 4/1969 | Poitras | 169/85 |
| 3,702,637 A | | 11/1972 | Bower | 169/31 |
| 3,713,493 A | | 1/1973 | Hansen | 169/31 |
| 3,844,356 A | | 10/1974 | Allen et al. | 169/75 |
| 3,861,474 A | | 1/1975 | De Palma | 169/75 |
| 4,034,813 A | | 7/1977 | Le Day | 169/26 |
| 4,159,744 A | | 7/1979 | Monte et al. | 169/26 |
| 4,276,938 A | | 7/1981 | Klimenko et al. | 169/47 |
| 4,319,640 A | | 3/1982 | Brobeil | 169/28 |
| 4,567,948 A | | 2/1986 | Roznieckí | 169/76 |
| 4,579,315 A | | 4/1986 | Kowalski | 251/67 |
| 4,637,472 A | | 1/1987 | Decima | 169/35 |
| 4,705,064 A | | 11/1987 | Self | 137/384 |
| 4,715,448 A | | 12/1987 | McCulloch | 169/62 |
| 4,889,189 A | | 12/1989 | Roznieckí | 169/73 |
| 5,423,384 A | | 6/1995 | Galbraith et al. | 169/12 |
| 5,660,236 A | | 8/1997 | Sears et al. | 169/72 |
| 5,836,364 A | | 11/1998 | Burton | 141/348 |
| 5,845,716 A | * | 12/1998 | Birk | 169/85 |
| 5,918,681 A | | 7/1999 | Thomas | 169/62 |
| 6,016,874 A | | 1/2000 | Bennett | 169/77 |

* cited by examiner

*Primary Examiner*—Gene Mancene
*Assistant Examiner*—Thach H Bui
(74) *Attorney, Agent, or Firm*—Wiggin and Dana LLP; Gregory S. Rosenblatt; Timothy J. Olson

(57) ABSTRACT

A discharge valve element seals the outlet of a fire extinguisher vessel holding a fire suppressant. A source of gas pressurizes the suppressant at least when the extinguisher vessel is in a discharging condition. When the pressure acting on the element exceeds the threshold, the force resisting opening the element is overcome and substantially eliminated, whereupon the suppressant discharges through the outlet.

20 Claims, 11 Drawing Sheets

HYBRID FIRE EXTINGUISHER

CROSS-REFERENCE TO RELATED APPLICATION

Benefit is claimed of U.S. Provisional Patent Application Ser. No. 60/127,084, filed Mar. 31, 1999.

BACKGROUND

This invention relates to fire suppression, and more particularly to fire extinguishers which may be installed within vehicles.

There are a wide variety of fire extinguishing technologies and fire extinguisher constructions. These include propellant-actuated extinguishers and extinguishers charged with compressed and/or liquified gas.

The basic features of an early propellant-actuated extinguisher are seen in U.S. Pat. No. 2,530,633 (Scholz). Scholz discloses a fire extinguisher wherein "a liquid extinguishing medium, such as methyl bromide, is expelled from its container by gas evolved from the burning of" a pyrotechnic charge. The charge is originally stored in a container which includes electric squibs. The charge container is mounted in an upper end of the vessel within a "container cup". Opposite the container cup, an outlet from the vessel is formed by an elbow fitting sealed by a rupturable diaphragm. Ignition of the pyrotechnic charge ruptures a wall of the charge container and vents combustion gases into the vessel. The combustion gases serve "as a gas piston acting on the surface of the liquid" rupturing the diaphragm which sealed the outlet and propelling the liquid out of the extinguisher.

The application of a propellant-actuated extinguisher to use in military vehicles is described in U.S. Pat. No. 4,319,640 (Brobeil). Brobeil discloses an extinguisher in many ways similar to Scholz. The exemplary fire suppressant utilized is Halon 1301. The lower end of the extinguisher vessel is sealed by a rupturable diaphragm. A as generating device is mounted atop the neck of the vessel. The exemplary gas generating composition is 62% sodium azide and 38% copper oxide.

U.S. Pat. No. 5,660,236 (Sears et al.) discloses the application of pressure from a gas generator to an annular piston which compresses a fire suppressant located in a central portion of a cylindrical container. This in turn induces the rupture of rupturable disks separating the suppressant from an apertured end portion of the cylindrical container. A portion of the combustion gas bypasses the piston and flows directly to the apertured end portion where it assists in vaporizing the fire suppressant and driving such suppressant from the extinguisher.

U.S. Pat. No. 4,889,189 (Rozniecki) discloses an extinguisher which utilizes a poppet-type "flush valve". A bladder separates a first chamber containing the suppressant from a second chamber to which the pressurizing gas is admitted. The bladder stretches on pressurization of the second chamber to drive the suppressant from the first chamber. The flush valve (mounted centrally within the bladder) opens once the bladder has reached its maximum stretch (having reduced the space occupied by the first chamber to a small fraction of the total container volume and driven nearly all of the suppressant from the container). The opening of the flush valve allows the propellant gas to be vented from the second volume through the first volume taking with it substantially the remainder of any suppressant.

U.S. Pat. No. 4,579,315 (Kowalski) discloses a pressurized Halon 1301 extinguisher. The extinguisher outlet is normally closed by a poppet valve. The poppet is held in its closed position by a latch which is released by a solenoid and thereby allows the pressure within the cylinder to drive the poppet to an open position.

U.S. Pat. No. 2,557,957 (Ferguson) discloses a manually-actuated, gas-pressurized aircraft fire extinguisher. The pressurant and suppressant are initially held in separate chambers. The two chambers are initially separated by both a membrane or closure and a sliding piston. The closure is ruptured via a manually-actuated piercing device, allowing the pressurant to drive the piston against the suppressant. The piston carries a poppet valve which opens once the piston has reached the end of its travel, allowing the pressurant to drive any residual suppressant from the extinguisher.

U.S. Pat. No. 3,861,474 (De Palma) discloses a dry chemical extinguisher utilizing a compressed gas pressurant. The outlet is normally sealed via mating of a first valve head with a seat. An outer tube circumscribes the seat and depends therefrom extending down and into the body of dry chemical. Concentrically within the outer tube is an inner tube. The lower end of the inner tube is normally sealed by a second valve head. Initially, both the ullage space and the inner tube are pressurized. The valve may be actuated manually or automatically. The automatic actuation is achieved via heating of gas within a bellows. Expansion of the bellows acts to disengage both the first head from its seat and the second head from the lower end of the inner tube. Although gas within the ullage space pushes down on the dry chemical, gas escaping from the inner tube entrains the dry chemical in an upward flow through the annular space between the inner and outer tubes.

U.S. Pat. No. 4,034,813 (Le Day) discloses a gas-pressurized extinguisher closed by a poppet valve having a head upstream and a valve extending downstream. The valve is held in a closed position by a pin having a pivoting end and a free end. The free end of the pin is held by a body of wax or a low melting point alloy. Heat from a fire softens the body, allowing the pressure within the extinguisher to drive the valve into an open position.

U.S. Pat. No. 4,159,744 (Monte et al.) discloses a nitrogen-pressurized extinguisher. The suppressant bottle is sealed by a poppet-type valve wherein the head faces the body of suppressant and the stem is directed outward. The valve opens into the bottle and is activated by either a squib or explosive cartridge acting upon a piston which bears against the stem.

There remains a further need for a high-performance fire extinguisher useful in vehicles and other enclosed spaces.

BRIEF SUMMARY OF THE INVENTION

One aspect of the invention is directed to a fire extinguisher comprising a bottle having an interior and a fire suppressant contained by the bottle when the extinguisher is in a pre-discharge condition. A source of gas pressurizes the suppressant at least when the bottle is in a discharging condition and the suppressant is discharged through an outlet when the extinguisher is in the discharging condition. A valve has a valve element having a closed position sealing the outlet and an open position permitting discharge of the suppressant through the outlet. The valve element is shiftable from the closed position to the open position responsive to a pressure within the bottle exceeding a discharge threshold pressure, whereupon the extinguisher enters the discharging condition and discharges the suppressant through the outlet.

In various implementations, the valve element may comprise a poppet having a head and a stem connected to the head. The head may have a fore surface facing the bottle interior and an opposite aft face from which the stem extends along a poppet axis. The valve may have a locking element which in the pre-discharge condition has a first portion engaged to the poppet and a second portion held relative to the bottle. In the pre-discharge condition the locking element transmits force to the poppet which retains the poppet in the closed position and, responsive to the pressure within the bottle exceeding the discharge threshold pressure the locking element ruptures, whereupon the pressure within the bottle drives the poppet to the open position and the extinguisher enters the discharging condition. A valve return spring may bias the poppet toward the closed position. The return spring is effective to return the poppet from the open position to the closed position when the fire suppressant has been substantially discharged from the extinguisher.

The valve element may comprise a head having a fore face facing the bottle interior and an opposite aft face and a collapsible shaft between the head and a valve body. In the pre-discharge condition, when the pressure within the bottle is lower than the discharge pressure, axial compression of the shaft may be effective to resist rearward movement of the head and retain the head in the closed position. Responsive to the pressure within the bottle exceeding the discharge threshold pressure the shaft may collapse via buckling, whereupon the pressure within the bottle drives the head to the open position and the extinguisher enters the discharging condition. The source of gas may comprise a chemical propellant charge. The chemical propellant charge may have a combustion temperature of less than about 1500° F. (816° C.). The chemical propellant charge may have gaseous combustion products consisting essentially of nitrogen, carbon dioxide, water vapor and mixtures thereof. The chemical propellant charge may consist essentially of a mixture of 5-aminotetrazole, strontium nitrate, and magnesium carbonate.

The source of gas may comprise a replaceable cartridge containing a chemical propellant charge. A cartridge holder assembly may hold the cartridge and may have a first end mounted within an aperture at an upper end of the bottle and a second end immersed within the suppressant when the extinguisher is in the pre-discharge condition. A closure, may close the first end. A replaceable squib may be mounted within the closure. The discharge threshold pressure may be between about 300 psi (2.1 MPa) and about 1500 psi (10.3 MPa). The fire suppressant may be selected from the group consisting of PFC's, HFC's, water, and aqueous solutions.

In another aspect, the invention is directed to a fire extinguisher having a bottle extending along a longitudinal axis from a first opening at a first end to a second opening at a second end, opposite the first end. The bottle may comprise the combination of a first piece extending longitudinally inboard from a mouth at the first end and a second piece extending longitudinally inboard from a mouth at the second end. The mouth of the second piece is substantially identical to the mouth of the first piece. A fire suppressant is contained by the bottle when the extinguisher is in a pre-discharge condition. A source of gas pressurizes the suppressant at least when the bottle is in a discharging condition. The suppressant is discharged through an outlet when the extinguisher is in the discharging condition.

In various implementations of the invention, the first and second pieces may be substantially identical. The first and second pieces may meet at an annular weld. The source of gas may comprise a propellant charge carried by a fixture secured within the mouth of the first piece. The outlet may be formed in a discharge assembly carried within the mouth of the second piece.

In another aspect, the invention is directed to a method for manufacturing a fire extinguisher. First and second pieces are provided each having a feature for engaging either one of a gas generator assembly and a discharge head assembly. The first and second pieces are assembled to form a bottle. The first and second pieces are optionally further modified. A discharge head assembly is provided. A gas generator assembly is provided. A fire suppressant is provided. The discharge head assembly is installed in the first piece of the assembled bottle. The gas generator assembly is installed in the second piece of the assembled bottle. The assembled bottle is filled with the suppressant. The assembling of the first and second pieces may comprise welding the first and second pieces together at a transverse centerplane of the bottle.

In another aspect, the invention is directed to a fire extinguisher comprising a bottle extending along a longitudinal axis from a first opening at a first end to a second opening at a second end, opposite the first end. The bottle has a failure pressure. A fire suppressant is contained by the bottle when the extinguisher is in a pre-discharge condition. A source of gas pressurizes the suppressant at least when the bottle is in a discharging condition. The suppressant is discharged through an outlet when the extinguisher is in the discharging condition. A poppet has a head and a stem connected to the head. The head has a fore face and an opposite aft face from which the stem extends along a poppet axis. The poppet has a closed position normally sealing the outlet and an open position permitting discharge of the suppressant through the outlet. The head has a preferential rupture zone which, upon an internal pressure in the extinguisher exceeding a safety threshold pressure ruptures so as to permit discharge of suppressant from the extinguisher, reducing the internal pressure and preventing the internal pressure from rising to within a safety margin of said failure pressure.

In various implementations of the invention, the preferential rupture zone may be proximate an annular groove in the head so that upon such rupture an annular peripheral portion of the head detaches from a core portion of the head. The fore face of the head may face the bottle interior. The source of gas may comprise a chemical propellant charge which, upon ignition elevates the internal pressure. In normal operation the poppet may be shiftable from the closed position to the open position responsive to the pressure within the bottle exceeding a discharge threshold pressure, less than said safety threshold pressure, whereupon the extinguisher enters the discharge condition and discharges the suppressant through the outlet. The safety threshold pressure may be between about 1000 psi (6.9 MPa) and about 2000 psi (13.8 MPa) and the discharge threshold pressure may be between about 300 psi (2.1 MPa) and about 1500 psi (10.3 MPa). The safety threshold pressure may be between about 1000 psi (6.9 MPa) and about 3000 psi (20.7 MPa).

In another aspect, the invention is directed to a fire extinguisher comprising a bottle having an interior. A fluid fire suppressant is contained by the bottle when the extinguisher is in a pre-discharge condition. The extinguisher has a preferred orientation for use in a gravitational field. In such preferred orientation the suppressant extends upward from a low point within the bottle interior to a surface level at a first height in the pre-discharge condition. The suppressant is discharged through an extinguisher outlet when the extinguisher is in the discharging condition. A chemical propellant charge combusts to produce combustion gasses which are introduced to the suppressant through a combustion gas outlet and elevate an internal pressure of the extinguisher above an initial pressure. The combustion outlet is located below the first height by a distance effective to cause mixing of the combustion gasses and the suppressant so that the suppressant discharged from the extinguisher is substantially mixed with at least a portion of said combustion gasses.

In various implementations of the invention, the suppressant may have a surface at the first height and the bottle interior contains an ullage space above the surface. The combustion outlet may be located within a lower half of a vertical distance from the extinguisher outlet to the first height. The combustion outlet may be located within a lower third of a volume of the suppressant. The combustion outlet may comprise a plurality of apertures positioned to direct the combustion gasses radially outward. The chemical propellant charge may have a combustion temperature of less than about 1500° F. (816° C.).

In another aspect, the invention is directed to a fire extinguisher comprising a bottle having an interior. A fire suppressant is contained by the bottle when the extinguisher is in a pre-discharge condition. A replaceable cartridge contains a chemical propellant charge. A cartridge holder assembly holds the cartridge and has a first end mounted within an aperture at an upper end of the bottle. A second end is immersed within the suppressant when the extinguisher is in the pre-discharge condition. A closure, closes the first end. A squib is mounted within the closure for igniting the propellant. A gas generator release poppet is spring biased toward a first position in which it blocks a path between the cartridge and the suppressant. Upon combustion of the propellant it shifts under pressure applied by combustion gasses to a second position wherein such path is unblocked and the combustion gasses may communicate with and pressurize the suppressant. The suppressant is discharged through an outlet responsive to the pressurization of the suppressant. A discharge poppet may close the outlet when the extinguisher is in its pre-discharge condition.

In another aspect, the invention is directed to a method for remanufacturing a discharged fire extinguisher. A spent propellant cartridge is removed from a cartridge holder mounted within an extinguisher bottle. A probe is inserted into the cartridge holder, causing the probe to seal with a sealing surface of the cartridge holder. A refill amount of fluid fire suppressant is delivered through the probe into a bottle interior the probe is extracted from the cartridge holder. A replacement propellant cartridge is inserted into the cartridge holder.

In various implementations of the invention, the insertion of the probe may cause a tip of the probe to depress a gas generator release poppet from a first position to a second position. In the first position the gas generator release poppet blocks a path between an interior portion of the cartridge holder and an interior portion of the bottle external to the cartridge holder. In the second position such path is unblocked and the refill amount of fluid fire suppressant may be delivered along such path. The extraction of the probe may allow the gas generator release poppet to return to the first position. A closure may be removed from the cartridge holder to permit the removal of the spent cartridge. A spent squib from the closure. The spent squib may be replaced with a fresh squib. The closure may be replaced so as to secure the replacement propellant cartridge within the cartridge holder.

In another aspect, the invention is directed to a fire extinguisher comprising a bottle having an interior. A fire suppressant is contained by the bottle when the extinguisher is in a pre-discharge condition and a replaceable cartridge contains a chemical propellant charge. A cartridge holder holds the cartridge and has a first end mounted within an aperture at an upper end of the bottle. A second end is immersed within the suppressant when the extinguisher is in the pre-discharge condition. A closure closes the first end. A squib is mounted within the closure for igniting the propellant. A replaceable gas generator relief plug initially seals a path between the cartridge and the suppressant. The plug has a centrally apertured metal body and a metal flap member initially secured to the metal body at least in part by a braze or solder joint which upon combustion of the propellant, pressure applied to the flap by combustion gasses emitted by the propellant is effective to rupture the joint so as to allow the flap to assume a position wherein such path is unsealed and the combustion gasses may communicate with and pressurize the suppressant. The suppressant is then discharged through an outlet responsive to the pressurization of the suppressant.

In various implementations of the invention, prior to combustion of the propellant the flap may have a first transversely extending portion secured by said joint to the body and a second longitudinally extending portion secured to the body by a second joint. The second joint may be a braze, a weld, or a solder joint.

In another aspect, the invention is directed to a fire extinguisher comprising a bottle having an interior. A fire suppressant is contained by the bottle when the extinguisher is in a pre-discharge condition. A gas generator assembly has a chemical propellant charge, and a body having at least one piece. The body has a first end mounted within an aperture at an upper end of the bottle. A second end is immersed within the suppressant when the extinguisher is in the pre-discharge condition. An initiator ignites the propellant. A gas generator relief poppet initially seals a path between the propellant and the suppressant. The poppet has a head having a fore surface facing the propellant and an aft surface and having a perimeter portion engaged to the body. A stem extends aft from the head. Upon combustion of the propellant, pressure applied to the head by combustion gasses emitted by the propellant is effective to rupture the head so as to separate a remainder of the gas generator relief poppet from the perimeter portion and allow the remainder to assume a position wherein such path is unsealed and the combustion gasses may communicate with and pressurize the suppressant. The suppressant is then discharged through an outlet responsive to the pressurization of the suppressant. In the pre-discharge condition movement of the discharge poppet toward the propellant may be prevented by interaction of a protuberance at a distal end of the stem with the gas generator assembly body about an aperture through which the stem passes.

In another aspect, the invention is directed to a fire extinguisher comprising a bottle having an interior. A fire suppressant is contained by the bottle when the extinguisher is in a pre-discharge condition. A replaceable cartridge contains a chemical propellant charge. A cartridge holder assembly holds the cartridge and has a first end mounted within an aperture at an upper end of the bottle. A second end is immersed within the suppressant when the extinguisher is in the pre-discharge condition. A closure closes the first end. An initiator assembly mounted within the closure ignites the propellant and has a body, a replaceable percussion cap primer having a primer charge, a firing pin, a spring, and a solenoid. The solenoid has a fixed coil and a plunger, coupled to the firing pin by a sear and shiftable, by energizing of the coil, from a first position at least to a second position. Such a shift draws the firing pin away from the primer until the plunger reaches the second position, whereupon release of the sear allows the firing pin to be driven by the spring to impact the primer and cause ignition of the primer charge which in turn causes ignition of the chemical propellant charge so as to pressurize the suppressant and discharge the suppressant from the extinguisher.

In various implementations of the invention, there may be a mechanism for manually shifting the plunger from the first position to the second position in the absence of energizing of the coil so as to provide a manual actuation of the extinguisher. There may be a control system for energizing the coil in response to: input from a fire sensor, and input from a manually actuatable switch providing manual actuation of the extinguisher.

In another aspect, the invention is directed to a fire extinguisher comprising a bottle having an interior. A fire suppressant is contained by the bottle when the extinguisher is in a pre-discharge condition. A holder assembly holds a chemical propellant charge and has a first end mounted within an aperture at an upper end of the bottle. A second end is immersed within the suppressant when the extinguisher is in the pre-discharge condition. A closure closes the first end. An initiator assembly is mounted within the closure for igniting the propellant and comprises triggering means for: (a) electrically triggering ignition of the propellant; and (b) mechanically triggering ignition of the propellant independent of electrical triggering.

The triggering means may comprise a squib for electrically triggering ignition of the propellant, and a percussion primer for mechanically triggering ignition of the propellant. The triggering means may comprise a replaceable percussion cap primer having a primer charge, a firing pin, a spring, and a solenoid. The solenoid may have a fixed coil and a plunger, coupled to the firing pin by a sear and shiftable, by energizing of the coil, from a first position at least to a second position. Such a shift may draw the firing pin away from the primer until the plunger reaches the second position, whereupon release of the sear allows the firing pin to be driven by the spring to impact the primer and cause ignition of the primer charge so as to provide the electrical triggering. There may also be a mechanism for manually shifting the plunger from the first position to the second position in the absence of energizing of the coil so as to provide the mechanical triggering.

Another aspect of the invention is directed to a method for remanufacturing a discharged fire extinguisher. A spent propellant container is removed from an extinguisher bottle. A replacement propellant container is inserted into the bottle. A discharge valve head and a collapsed shaft are removed from a discharge head assembly. The discharge valve head and collapsed shaft are replaced with a replacement head having a fore face facing the bottle interior and an opposite aft face: and a replacement collapsible shaft. A refill amount of fluid fire suppressant is delivered through a fill valve into a bottle interior.

The removal of the discharge valve head and the collapsed shaft from the discharge head assembly may involve unscrewing a discharge head end closure from an aperture of a body of the discharge head. The discharge head end closure may have a socket initially accommodating an aft end of the collapsed shaft. The discharge valve head and the collapsed shaft may be extracted through the aperture. The discharge head end closure may be replaced so that the socket accommodates an aft end of the replacement collapsible shaft. The bottle interior may be evacuated through the fill valve prior to delivering the refill amount of fluid fire suppressant.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
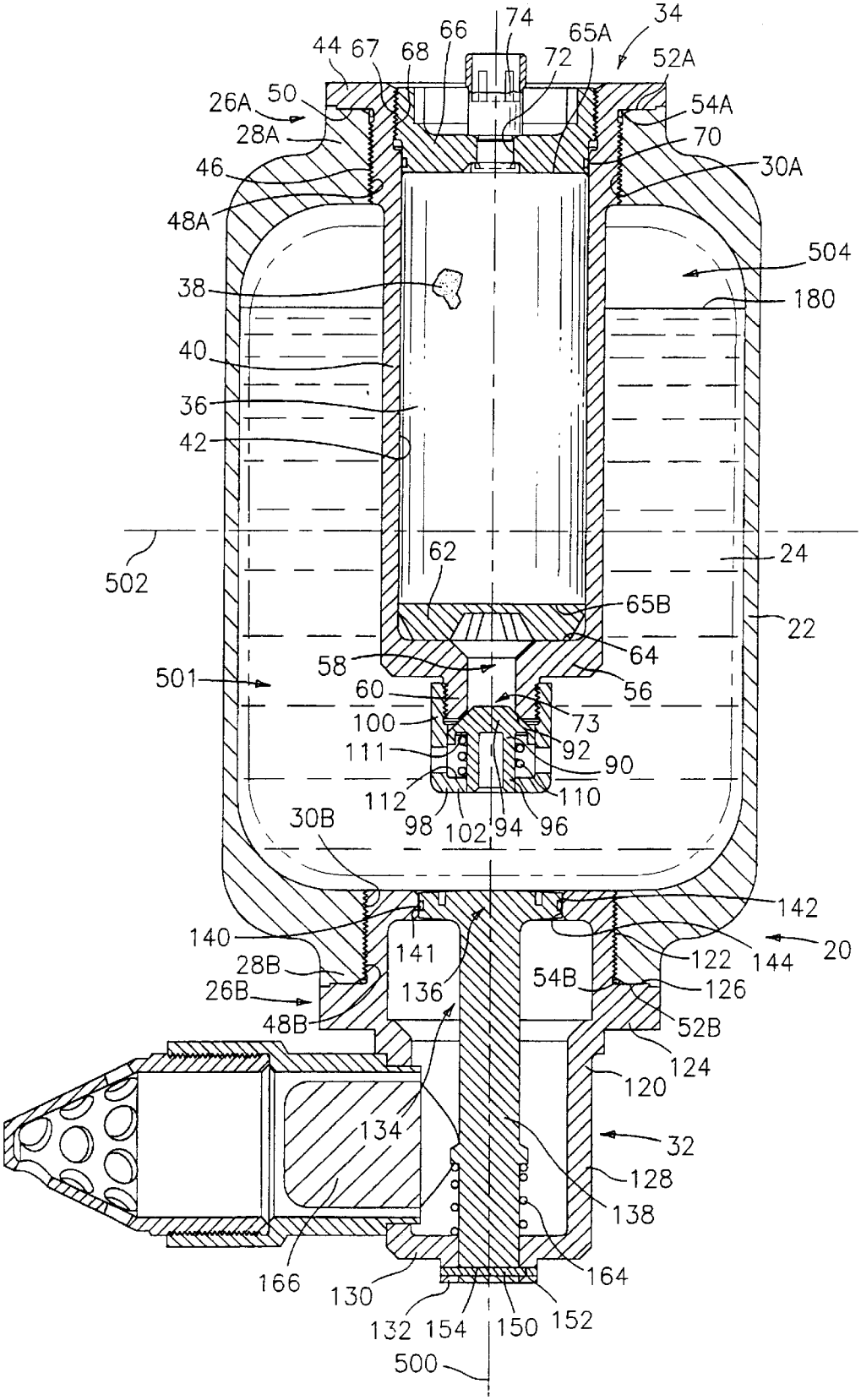
FIG. 1 is a longitudinal cross-section view of a fire extinguisher of FIG. 1 with combustion gases beginning to pressurize a fire suppressant.

FIG. 1 shows an extinguisher 20 which is advantageously mountable within a confined space such as an aircraft cockpit, armored vehicle crew compartment, ammunition storage compartment, and the like. The extinguisher includes a vessel or bottle 22 which contains a body of fluid fire suppressant 24. A particularly preferred suppressant is HFC-227ea ($CF_3CHFCF_3$). The bottle extends along a central longitudinal axis 500 from a first end 26A to a second end 26B. Preferably, the bottle is oriented so that the axis 500 is vertical, the first and second ends respectively being the upper and lower ends. The bottle 22 is preferably formed of metal such as 4000 series alloy steel (a molybdenum-containing steel (typically 0.12–0.52 weight percent) with optional nickel and/or chromium content) and may be manufactured by a process described below. At each end 26A and 26B, the bottle has a respective neck 28A and 28B having an aperture 30A and 30B extending into the bottle interior 501. The lower neck 28B carries a discharge head assembly 32. The upper neck 28A carries a gas generator assembly 34. In a preferred embodiment containing about five pounds (2.27 kg) of HFC-227ea, the bottle has an approximate diameter of about 5–6 inches (13–15 cm) and an approximate end-to-end length of about 8–10 inches (20–33 cm), giving the extinguisher an overall length of approximately 11–13 inches (28–33 cm). These dimensions may be modified or scaled as appropriate for a particular application.

The gas generator assembly 34 includes a replaceable cylindrical metallic cartridge 36 containing a chemical propellant 38 contained within foraminate tubes (not shown), the remainder of the assembly 34 serving as a cartridge holder. Upon combustion, the chemical propellant produces copious amounts of combustion gases to pressurize the extinguisher. The combustion gases are preferably noncombustible. Exemplary propellants may consist essentially of a compacted mixture of a nitrogen-containing powder fuel, a powder oxidizer, and preferably a powder coolant. The coolant serves to keep the temperature of the combustion gases sufficiently low to avoid an unwanted degree of vaporization or thermal decomposition of the suppressant or and/or to keep the suppressant discharged from the extinguisher relatively safe for contact with the vehicle occupants. A particularly preferred propellant is manufactured by Primex Aerospace Company (PAC) of Redmond, Wash. under the trademark FS01-40. A preferred amount of such propellant is about 0.1–0.125 g per each g of HFC-227ea, or about 0.25 g per g of water-based supressant. An exemplary replaceable cartridge containing FS01-40 propellant is manufactured by PAC as PAC Part No. 33780-302.

FS01-40 is a mixture consisting nominally of 21.9% 5-aminotetrazole (5-ATZ). 38.1% strontium nitrate, and 40.0% magnesium carbonate, by weight. Upon combustion, FS01-40 generates water, nitrogen, and carbon dioxide gases, as well as strontium oxide (SrO), strontium carbonate ($SrCO_3$) and magnesium oxide (MgO) particulate. The Naval Air Warfare Center's "PEP" thermodynamic modeling code (NWC-TP-6037, Rev. 1, 1991) was used to calculate equilibrium exhaust compositions for FS01-40 propellant. The PEP output consisted of a tabulation of all major gaseous, liquid and/or solid exhaust species present at equilibrium combustion conditions of 1,000 psi (6.9 MPa) chamber pressure:

| Volume % Gases in Exhaust @ 1000 psi (6.9 MPa) | | | | | |
|---|---|---|---|---|---|
| CO | $CO_2$ | $H_2$ | $H_2O$ | $N_2$ | Total |
| 0.04% | 36.59% | 0.01% | 20.22% | 43.15% | 100% |

These are in addition to particulate components of SrO, $SrCO_3$, and MgO. There may be a level of error in the calculations utilized. Even with such error, it is seen that the three key. non-flammable components ($CO_2$, $H_2O$, and $N_2$) account for in excess of 99% of the combustion gases with the more reactive gases (CO and $H_2$) constituting less than 1%. Thus, although the individual amounts of the non-flammable components may not in and of themselves be critical, however, their combined total should be effective to render the combustion gases, as a whole, non-flammable and highly effective for fire suppression.

The cartridge 36 is replaceably mounted within a cylindrical cartridge-receiving sleeve or cartridge holder 40. The holder 40 is substantially symmetric about the central longitudinal axis 500. Along the majority of this length, the holder 40 has a cylindrical interior surface portion 42 for laterally retaining the cartridge 36. At its upper end, the holder 40 has an angular flange 44. An externally threaded portion 46 of the holder is immediately below the flange. The externally threaded portion is engaged to an internally threaded portion 48A of the upper neck 28A at the aperture 30A so that the lower annular surface 50 of the flange 44 abuts an outboard annular rim surface 52A of the upper neck 28A. An O-ring seal 54A proximate the junction of the lower surface 50 and externally threaded portion 46 seals the holder 40 to the bottle 22. At the lower end of the cylindrical interior portion 42, a web or end plate 56 extends inward to a central aperture 58 about which a neck 60 depends from the end plate 56. A six-armed spider plate or standoff 62 stands atop the upper surface 64 of the end plate 56 and in turn supports the bottom 65B of the cartridge 36. The upper end of the sleeve/holder 40 is sealed by a cover or plug 66 having an externally threaded portion 67 engaged to an internally threaded portion 68 of the holder 40 extending downward from the upper end of the holder. Exemplary materials for both the plug and sleeve are 4000 series steel, heat treated and plated (e.g. with nickel) for corrosion resistance. An O-ring seal 70 carried in a radially outward facing groove in a lower portion of the plug 66 seals the plug to the interior surface of the holder. The plug 66 in turn has a central aperture 72 which receives an initiator or squib 74. An exemplary squib may be manufactured according to United States Military Standard I-23659. The squib contains a small explosive charge (not shown) and electrical leads for connecting the squib to an external control circuit. When an appropriate voltage is applied to the leads, the explosive charge is ignited. Ignition of the explosive charge causes rupture of a scored area of the cartridge 36 allowing burning material from the explosive charge to enter the cartridge and ignite a small pilot charge (not shown) which in turn ignites the propellant 38 in the cartridge. Upon combustion of the propellant 38, the pressure within the cartridge increases dramatically. The holder 40 and plug 66 respectively restrain breakage of the sidewall and the top 65A of the cartridge. However, the unsupported portions of the cartridge bottom 65B (located between the legs of the spider 62) rupture (e.g., at an exemplary rupture pressure of about 50 psi (0.34 MPa)), venting propellant gases downward between the legs and into a central cylindrical portion 73 of the holder within the neck 60. The propellant gases then encounter a gas generator release poppet 90 which normally seals a beveled mouth 92 proximate the lower end of the neck 60. The poppet 90 has a beveled head 94 and a tubular stem 96 depending from the head. The poppet 90 is carried within a cup-shaped poppet holder 98 comprising the unitarily-formed combination of a substantially cylindrical vertically-extending sidewall 100 and a centrally apertured web 102 at the lower end of the sidewall. Exemplary materials for the poppet 90 and poppet holder 98 are intermediate or low carbon steels, preferably plated for corrosion resistance. An upper portion of the sidewall is internally threaded and engaged to an externally threaded outer surface portion of the neck 60. The lower end of the stem is accommodated within the aperture of the web 102. The outermost peripheral portion of the head 94 is in sliding engagement with the interior surface of the sidewall 100 so that the poppet holder 98 holds the poppet 90 for vertical reciprocal movement between: a closed position sealing the mouth 92; and an open position described below. A coil-type spring 110 surrounds the stem 96 and is longitudinally held under compression between a lower (aft) surface 111 of the head and an upper surface 112 of the web 102. The spring 111 thus biases the poppet into its closed position.

Figure 2:
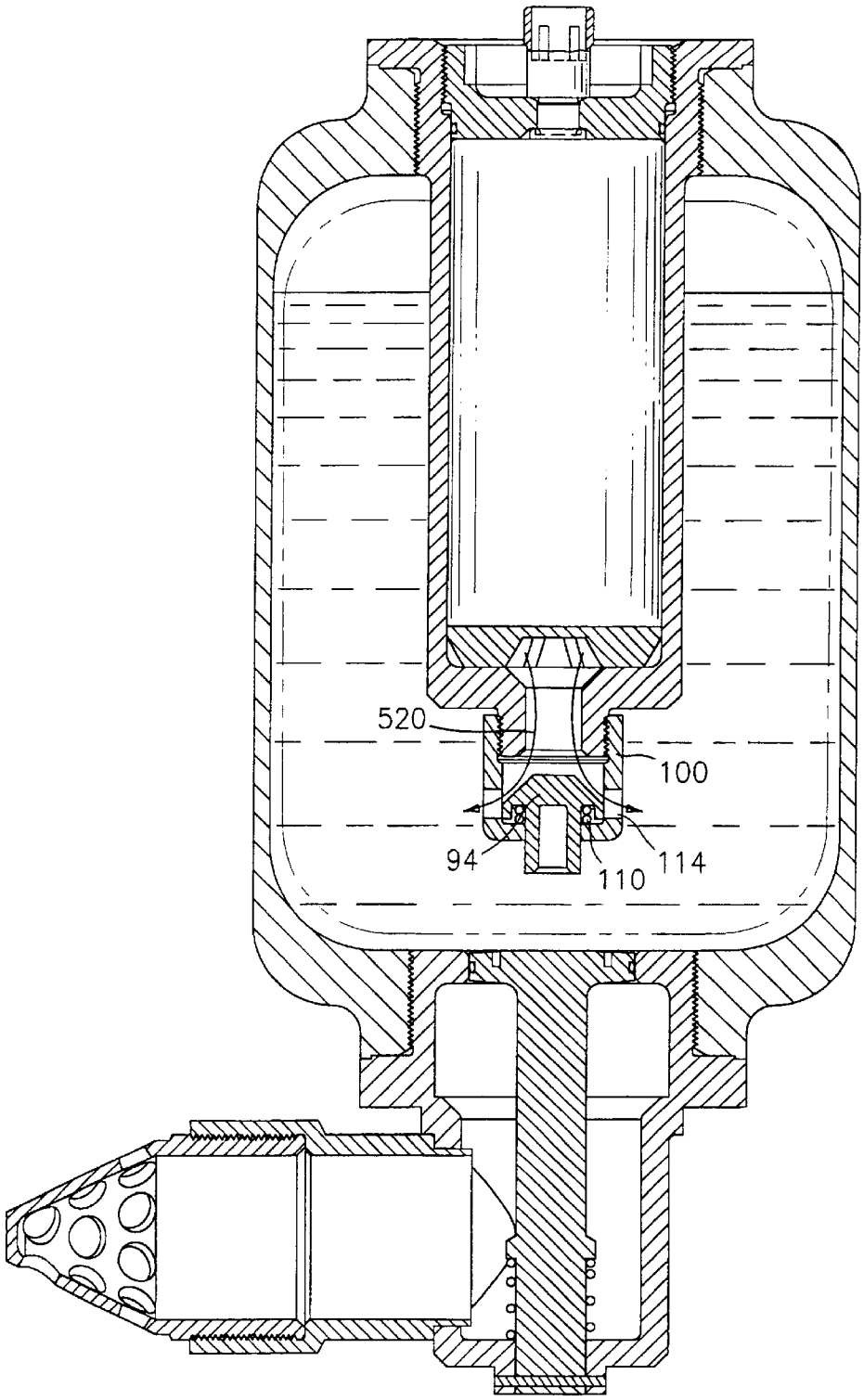
FIG. 2 is a longitudinal cross-sectional view of the fire extinguisher of FIG. 1 with combustion gases beginning to pressurize a fire suppressant.

Upon ignition, as the propellant eases flow into the neck 60 they apply pressure to the upper (front) surface 113 of the poppet head which quickly reaches a release pressure and overcomes the bias force of the spring 110 and drives the poppet downward to a fully opened position show in FIG. 2 while compressing the spring 110. More compressive force will be required to hold the spring 110 compressed in the fully opened position than when initially opening. An exemplary release pressure range is about 100 psi (0.7 MPa) at which the poppet begins to open to about 500 psi (3.4 MPa) at which the poppet is held fully open. There are a series of radial apertures or flow ports 114 in the sidewall 100 located aft of the poppet head 94 when the latter is in its closed position. When the poppet head is in its open position, it has passed sufficiently below the upper extremities of ports 114 to expose the ports to the combustion gases and allow the combustion gases to flow through the ports along a flow path portion 520 into the body of suppressant. Once the suppressant is exposed to the combustion gases, the pressure within the bottle increases dramatically. Other mechanisms which supply a releaseable resistive force (e.g., a detent mechanism) may replace the shear pin arrangment.

In both FIG. 1 and FIG. 2 the features of the discharge head assembly 32 are seen in a pre-discharge condition. The assembly has a body 120 having an externally threaded upper portion 122 engaged to the internally threaded portion 48B of the lower neck 28B. Immediately below the upper portion 122 and extending radially outward is a flange 124. The upper surface 126 of the flange 124 abuts the annular rim surface 52B of the lower neck 28B. An O-ring 54B carried by the body at the junction of the upper portion 122 and flange 124 provides a seal between the body 120 and the bottle. A lower portion 128 of the body depends from the flange 124. A centrally apertured web 130 is located at the lower end of the lower portion 128. A neck 132 depends from the web 130. The discharge head assembly functions, inter alia, as a valve, with the body 120 carrying a poppet 134 as the valving element. At its upper end, the poppet 134 has a disk-like head 136 from which depends a solid stem 138. The lower end of the stem 138 extends into the central aperture of the web 130 and neck 132. In its closed position, the poppet 134 seals the suppressant within the bottle interior. The seal is provided by an O-ring 140 in a radially outward-directed channel 141 in a cylindrical lateral surface 142 of the head. The O-ring 140 seals the head to a cylindrical interior surface 144 at the upper end of the body 120. The poppet 134 is normally secured in its closed position. This is achieved by the presence of a shear pin 150 extending through a transverse hole 152 in the neck 132 and coaligned hole 154 in the stem. The shear pin 150 may be secured in place such as by means of a press fit within the hole 152. Such a press fit may be into both of the two radially opposite portions of the hole 152 or only one of the two. The pressurization of the extinguisher interior caused by the combustion gases exerts a large downward force on the poppet 134 which is initially resisted via the shear strength of the shear pin 150. However, the size and shear strength of the shear pin 150 are selected so that the shear pin will rupture (via shearing) when the internal pressure reaches a predetermined discharge threshold pressure. An exemplary discharge threshold pressure is in the range from about 300 psi (2.1 MPa) to about 1,500 psi (10.3 MPa), a more preferred range being 400 psi (2.8 MPa) to 1.000 psi (6.9 MPa) and a particularly preferred discharge threshold pressure being about 500 psi (3.4 MPa). Exemplary materials for the body 120 and poppet 134 are intermediate carbon steels, preferably plated for corrosion resistance. The poppet is preferably hardened adjacent its lower end for improved engagement with the shear pin. Alternatively, the poppet may contain a hardened bushing for engaging the shear pin.

When the shear pin 150 ruptures, the poppet 134 is driven from its normally closed position to an open position (shown in FIG. 3) wherein the suppressant can communicate with the interior of the body 120 and flow along a flow path portion 522 through an extinguisher outlet which, in the exemplary embodiment, is provided by a nozzle assembly 160 mounted in a lateral aperture in the lower portion 128 of the body 120.

Figure 3:
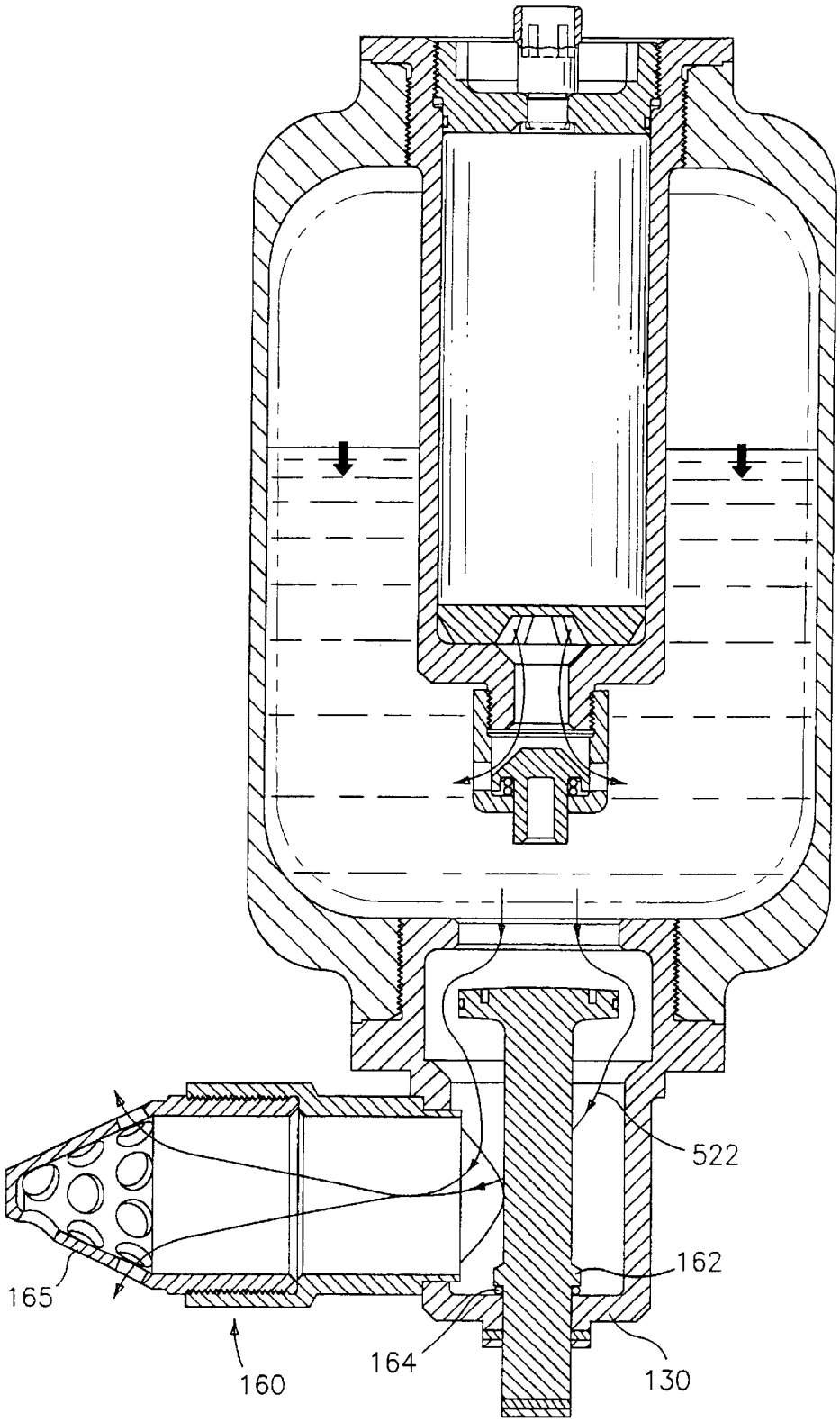
FIG. 3 is a longitudinal cross-sectional view of the extinguisher of FIG. 1 in a discharging condition responsive to such pressurization.

The poppet 134 may be provided with features which prevent its movement below a fully opened position of FIG. 3. As an exemplary such feature, at an intermediate location along the stem there is a radially outwardly-projecting flange 162. The flange can engage the web 130 (either directly or via an O-ring 163 or a light compression spring 164 (FIG. 1)) to prevent movement of the poppet 134 beyond the fully opened position. With the poppet 134 in its fully opened position, the combustion gases can drive the suppressant out through the nozzle 165 to suppress a fire.

An optional feature is the provision of a supplemental body 166 (FIG. 1) of a particulate fire suppression agent, such as sodium bicarbonate ($NaHCO_3$). The sodium bicarbonate may be packed within the nozzle assembly as shown or may be otherwise located downstream of the suppressant. When the supplemental body is present, it is driven out of the extinguisher by the initial flow of suppressant and combustion gases.

As the suppressant and combustion gases are discharged, the pressure within the extinguisher will eventually begin to drop again. At a point when the extinguisher has substantially fully discharged so that the internal pressure drops to a very low value (e.g., on the order of about 10 psi (700 kPa) preferably about 5–20 psi (300 kPa–1.4 MPa)) tile spring 164 can return the poppet 134 to its closed position. The poppet head 138 and lateral surface 142 of the body may be slightly beveled or otherwise provided with a feature which restrains movement of the discharge poppet above its closed position. Similarly, the spring 110 will return the as generator release poppet to its closed position. At this point the extinguisher is ready for remanufacture.

To remanufacture the extinguisher, the ruptured shear 150 pin may be driven out or otherwise removed and replaced with a fresh shear pin. The plug 66 may be removed from the holder 40 whereupon the spent gas generator cartridge 36 may be removed. The spent squib 74 may be removed from the plug 66 and replaced with a fresh squib. To refill the extinguisher with suppressant, the spider 62 may be removed and a probe 170 (FIG. 4) inserted through the holder 40. The probe 170 is formed as a hollow tube which may have a frustoconical shoulder or other feature for sealing with a beveled opening 174 of the aperture 58 in the endplate 56. A lower end of the probe 176 depresses the poppet 90 to an open position. Proximate its lower end, the probe has ports 178. The extinguisher may be evacuated through the probe. The probe then delivers the suppressant through its ports 178 and the extinguisher's flow ports 114 until a desired amount of suppressant has been delivered. The probe is then withdrawn, whereupon the gas generator release poppet 90 is returned to its closed position via the spring 110. The spider is replaced and a fresh propellant cartridge 36 inserted into the holder 40. The plug 66 is then screwed back into place and, and if not already installed, the fresh squib is installed.

When compared with propellant-actuated extinguishers which utilize rupturable membranes to seal an extinguisher outlet, use of a valve such as the present poppet valve has a number of advantages. One advantage is ease of remanufacturing of an expended extinguisher. The valve may be made resetable without any great degree of disassembly of the extinguisher whereas significant disassembly may be required to replace a membrane. Additionally, the valve may be constructed to reliably open at a relatively high discharge threshold pressure. A membrane may not readily be provided having the same combination: of high discharge threshold pressure; and consistent performance. The high discharge threshold pressure provides relatively efficient use of both the suppressant and the propellant. It better temporally aligns the discharge of suppressant with the combustion of the propellant. Thus, the initial suppressant release by the extinguisher will be release at a higher pressure and thus will be more effectively dispersed through the target zone. Furthermore, the combustion reaction will have proceeded further toward completion so less combustion gas is left after the final amount of suppressant has been discharged. Compared with a rupturable metal membrane having a similar discharge threshold pressure, the illustrated valve may involve less generation of unwanted, potentially dangerous, particulates. Namely, a rupturable metal membrane may produce small shards of metal upon rupturing. These will be propelled out of the extinguisher and may injure vehicle occupants.

Another advantage of the illustrated extinguisher configuration arises from the intimate mixing of combustion gases and suppressant achieved by locating the outlet (the flow ports 114) from the gas generator well within the body of suppressant. Many fire extinguishers use combustion gases, compressed gases, or other pressurizing means to simply squeeze the suppressant out of the extinguisher. This may often be achieved by venting the combustion or compressed gases into the ullage space 504 above the upper surface 179 of the body of suppressant (FIG. 1). It may also be achieved by separating the combustion or compressed gases from the suppressant via a membrane, bladder or the like. In the exemplary embodiment, the flow ports 114 are located well within the lower half of the vertical distance between the bottom of the fluid body at the discharge poppet and the upper surface of the fluid body. More particularly, in the embodiment, the ports 114 are well within the lower third of this distance and located approximately one quarter of this distance above the bottom of suppressant. Thus, in distinction to existing systems wherein the combustion or compressed gases first drive substantially all the suppressant out of the extinguisher and then (if not separated from the suppressant) themselves are vented, the output of the exemplary extinguisher is a mixture of the suppressant with the combustion gases. This provides an advantageous dispersion of the suppressant and further utilizes the fire suppression capability of the combustion gases, which, as described above, may include steam, carbon dioxide, and nitrogen.

Figure 4:
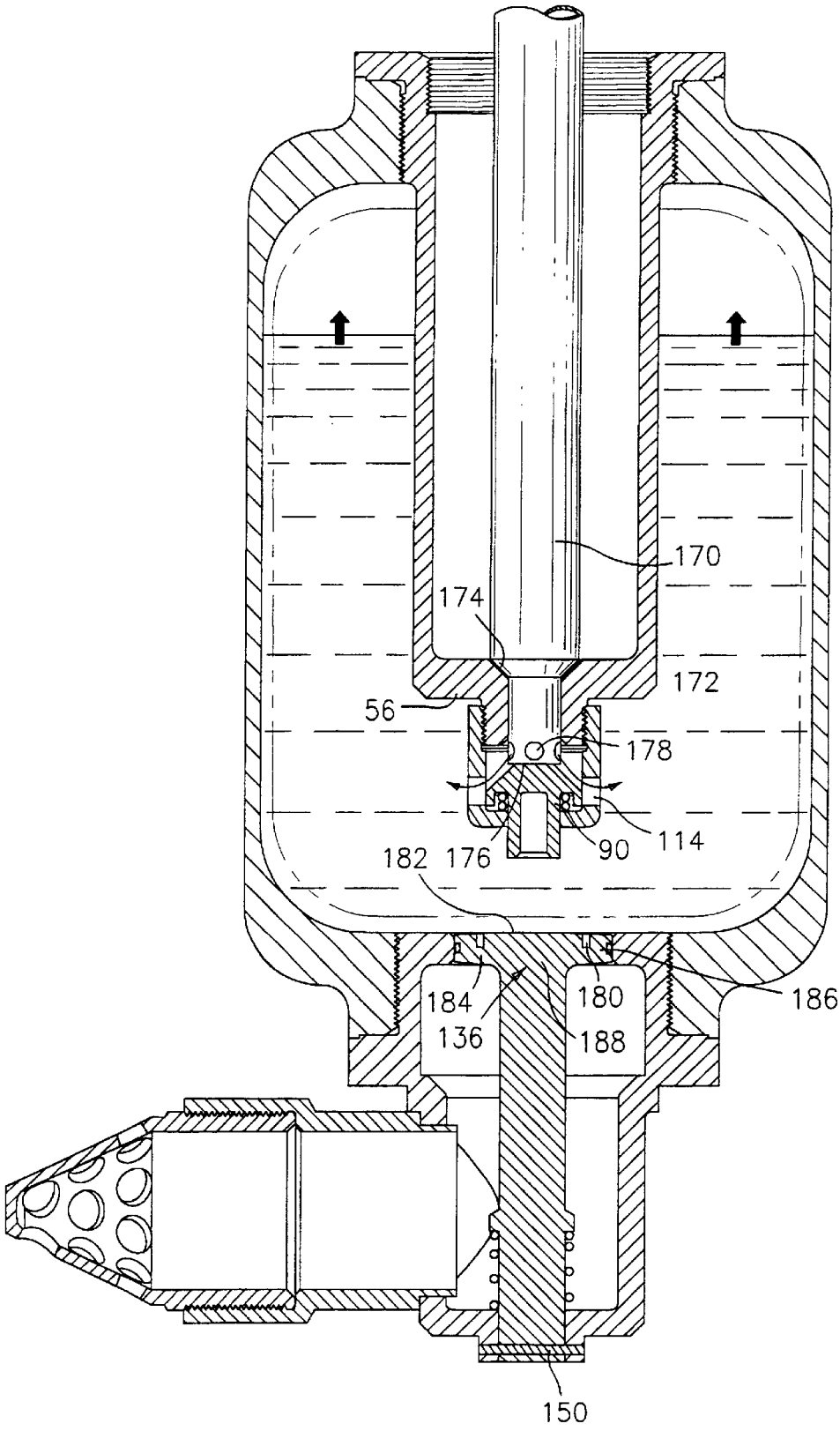
FIG. 4 is a longitudinal cross-sectional view of the extinguisher of FIG. 1 during refilling.
Figure 5:
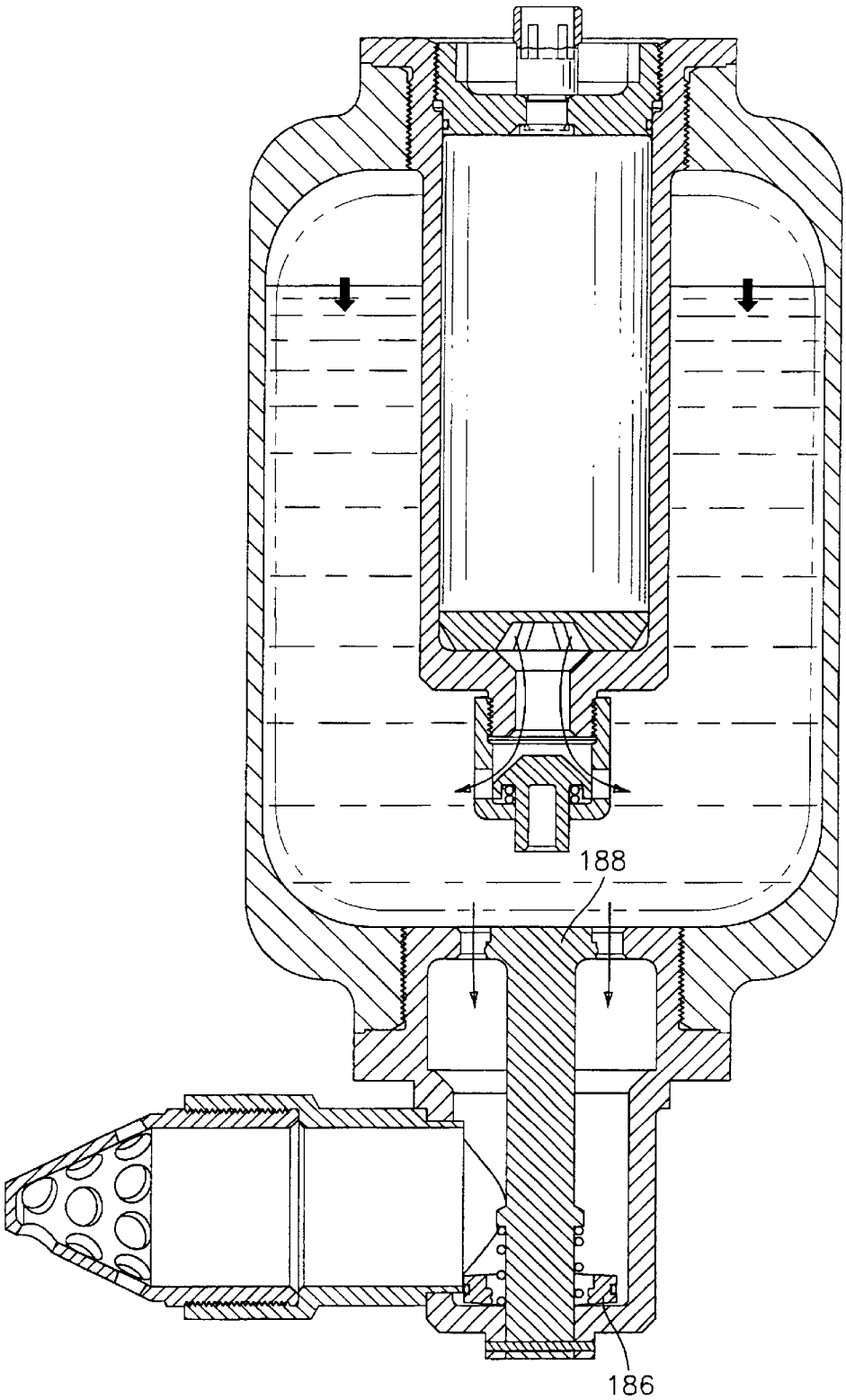
FIG. 5 is a longitudinal cross-sectional view of the extinguisher of FIG. 1 upon a safety-related rupturing of a poppet valve.

FIG. 4 shows an optional safety feature which may be incorporated into the discharge poppet valve. An annular groove 180 in the front face 182 of the discharge poppet head 136 provides a weakened peripheral rupture zone 184. Particularly when utilized in aircraft and military vehicles, an extinguisher may be subject to damage associated with collision, ordnance impact, and the like. If such damage affects the discharge head assembly or otherwise obstructs the discharge poppet, preventing the poppet from moving to an open position, ignition of the propellant will rapidly cause the pressure within the extinguisher to exceed the maximum pressure the bottle can withstand without rupturing. If this bottle failure or rupture pressure is exceeded, the bottle may explode, further damaging the vehicle structure and potentially injuring or killing vehicle occupants. To prevent such an event, the groove is 180 dimensioned and positioned so that the peripheral rupture zone 184 (immediately aft of the groove in the illustrated embodiment) does not have sufficient strength to remain intact when the pressure in the extinguisher exceeds a safety threshold pressure (below the bottle failure pressure by a desired margin of safety). In the exemplary embodiment, when the internal pressure reaches the safety threshold pressure, the pressure acting upon an annular peripheral portion 186 of the head 136 outboard of the groove 180 separate is sufficient to cause the peripheral portion to shear and from a core portion 188 of the head 136 inboard of the groove 180 and be driven down into the discharge head body (FIG. 5). The suppressant/combustion gas mixture is then free to flow around the core portion and exit through the nozzle. Thus not only is explosion avoided but the extinguisher discharges in a manner effective for fire suppression. By way of example, an exemplary rupture pressure of the bottle may be in the vicinity of from about 4000 psi (28 MPa) to about 6000 psi (41 MPa). The safety threshold pressure will preferably be from about 500 psi (3.4 MPa) to about 1,000 psi (6.9 MPa) or more greater than the discharge threshold pressure and may roughly be about 50% of the rupture pressure. An exemplary safety threshold pressure is from about 1,000 psi (6.9 MPa) to about 2,000 psi (14 MPa) but preferably less than about 3000 psi (21 MPa).

Another advantage of the exemplary bottle configuration is associated with the bottle having substantially similar features at its upper and lower ends. The bottle may be initially formed of separate upper and lower pieces. Each of the upper and lower pieces may be initially identically formed such as by impact extrusion. The two pieces may further be subjected to identical machining processes such as the formation of identical threads for respectively receiving the gas generator assembly and discharge assembly. The two pieces are then joined at a weld along, a transverse centerplane 502 (FIG. 1) to form the bottle. By interchangeably forming upper and lower pieces, manufacturing costs are reduced. Optionally, this principle may be utilized in other ways. For example, if pieces of two different lengths but each having similar features for receiving the discharge head assembly or the gas generator assembly are provided, then these two different pieces can be combined in three different combinations to produce three different sizes of extinguisher. A small extinguisher can be formed by utilizing two of the smaller size pieces for both the upper and lower portions of the bottle: a large size bottle may be manufactured by utilizing two of the larger pieces for both the upper and lower pieces of the bottle; and an intermediate size of bottle may be manufactured by utilizing one of each size piece. As a further option, the size of the bottle may be controlled by interposing a sleeve of a given length between the two identical pieces and welding such sleeve to each piece.

Figure 7:
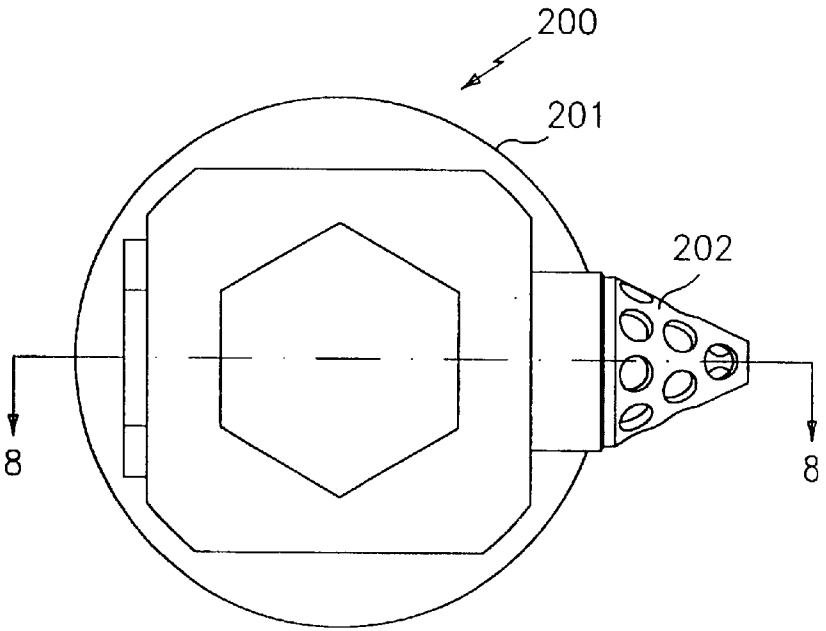
FIG. 7 is a bottom view of the extinguisher of FIG. 6.
Figure 6:
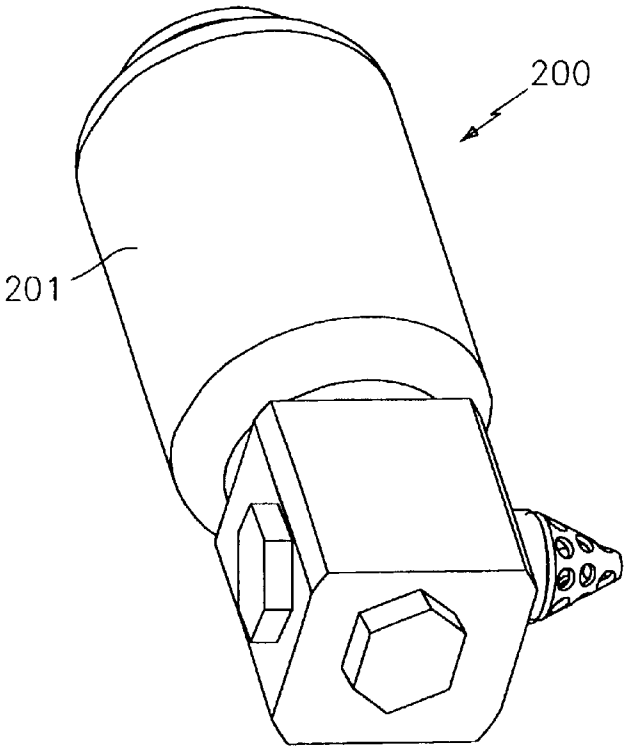
FIG. 6 is a view of the second fire extinguisher according to principles of the invention.
Figure 8:
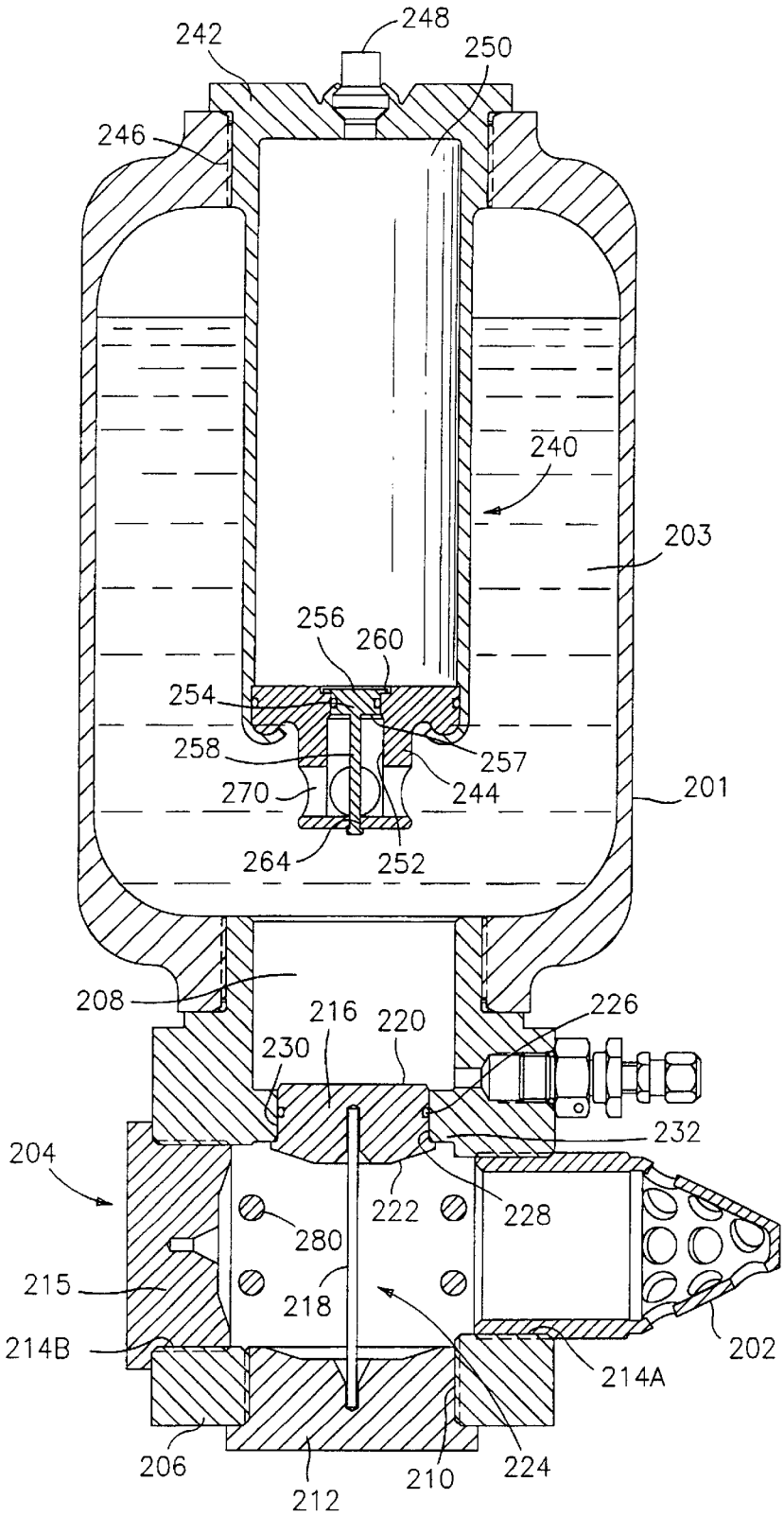
FIG. 8 is a longitudinal cross-sectional view of the extinguisher of FIG. 6.

FIGS. 6–8 show an alternate extinguisher 200. The extinguisher includes a bottle 201. nozzle 202, and a body of suppressant 203 which may be similar to those of the extinguisher 20. A discharge head assembly 204 serves as an outlet valve. The discharge head assembly has a body 206 having an externally threaded upper end which is received by the lower neck of the bottle. The body 206 has an upper channel/port 208 within its upper end in continuous fluid communication with the bottle interior. The body has a coaligned internally threaded lower port 210 which receives an externally threaded plug 212. The body 206 has a pair of coaligned internally threaded transverse ports 214A and 214B which respectively receive the nozzle 202 and a second plug 215 which, for economy of manufacture, may be identically formed to the first plug 212. The body and plugs are preferably formed of a low carbon steel which may be plated for corrosion resistance. A valve element is provided by a valve head 216 normally supported by a collapsible shaft 218. The head is preferably formed of brass or a low to medium carbon steel while the shaft is preferably formed of a high carbon steel. The valve has a fore face 220 facing the bottle interior and an opposite aft face 222 facing an outlet chamber 224. An approximately cylindrical lateral surface 226 of the head 216 is concentrically within a throat 228 of the body 206 which forms an outlet for the suppressant. In the closed position of FIG. 8, the head 216 is sealed to the throat 228 via an O-ring accommodated within a channel in the lateral surface 226. Upstream longitudinal movement of the head 226 beyond the closed position is restrained via cooperation of a downstream flange 230 projecting radially outward from the lateral surface 226 with a downstream shoulder 232 of the throat. Downstream movement of the head is restrained by the compressive strength of the shaft 218 which has an upstream end accommodated within a blind compartment extending upstream from the aft face 222 of the head 266 and a downstream end accommodated within a similar blind compartment in the plug 212.

The extinguisher 200 also includes a disposable gas generator assembly 240. The assembly 240 includes a metallic body having first and second pieces 242 and 244. An externally threaded upper portion 246 of the body/first piece 242 is received within the upper neck of the bottle. The tipper end of the first piece is formed by a centrally apertured web carrying a squib 248. The squib may be crimped in place as shown. A propellant cartridge or canister 250 contained within the gas generator assembly 240 may be similar to that of the extinguisher 20. The second piece 244 may be captured within a sleeve portion of the first piece 242 and crimped in place to retain the canister 250 within the gas generator assembly. An upper annular surface of the second piece contacts and supports the lower surface of the canister. A central longitudinal channel 252 extends from the upper end of the second piece 244. Proximate the upper end of the channel 252 the head 254 of a gas generator relief poppet initially seals the channel. The head has a fore surface 256 facing the canister and an aft surface 257 from which depends a stem 258.

At its fore surface 256, the head includes a radially outward-projecting flange 260 accommodated within a counterbore portion of the channel 252 and cooperating with a forward surface of the counterbore to restrain the head against downward (downstream) movement. The stem 258 extends through an aperture 264 in a lower end of the second piece and, at its lower (distal) end bears a protuberance 265 which cooperates with the lower end of the second piece to prevent upward movement of the gas generator relief poppet. The gas generator relief poppet may be formed of a brass via screw machining, the protuberance formed after assembly with the second piece. A series of transverse ports 270 establish communication between the channel 252 and the portion of the bottle interior external to the gas generator assembly.

Figure 9:
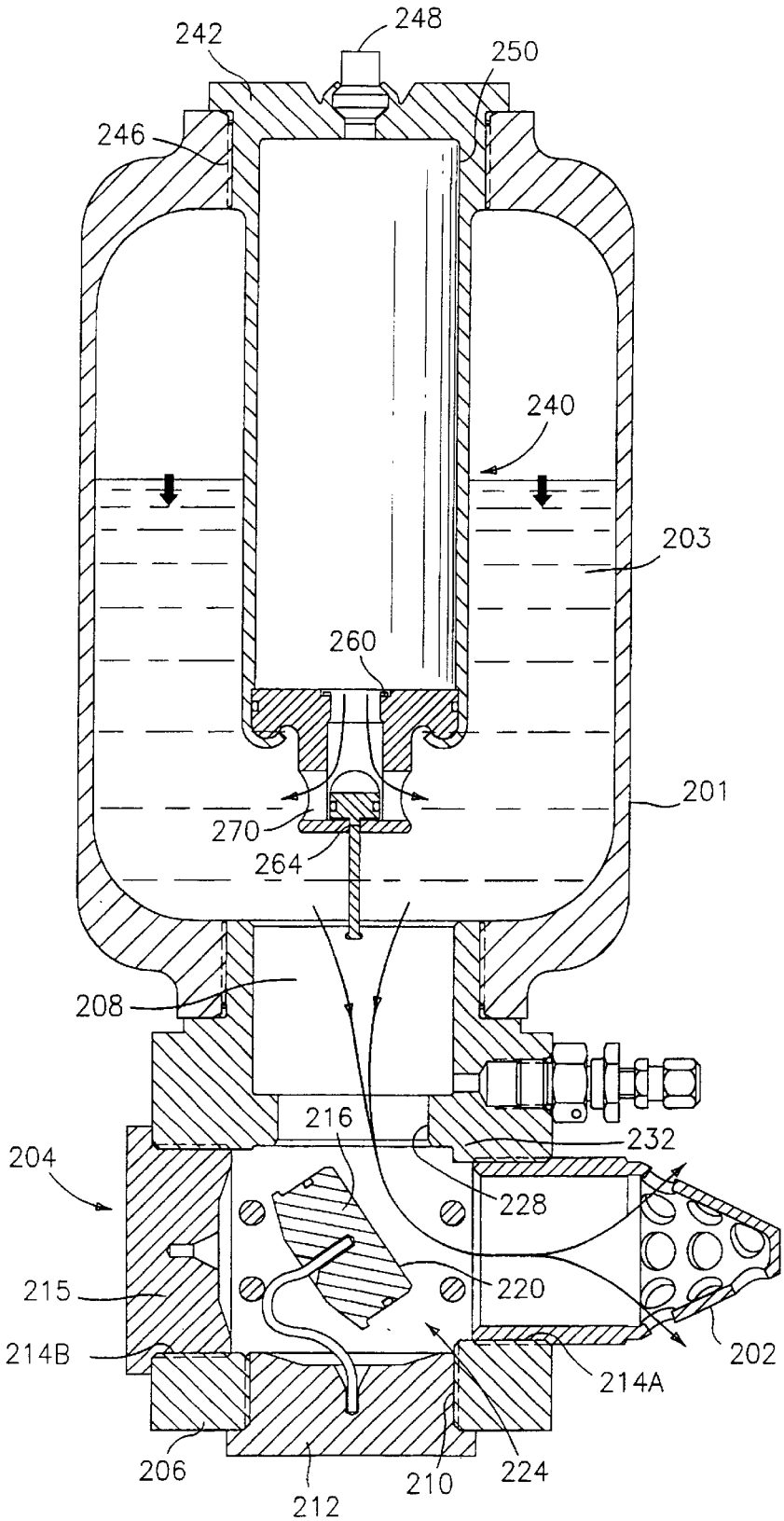
FIG. 9 is a longitudinal cross-sectional view of the extinguisher of FIG. 6 in a discharging condition.

In operation, the squib 248 is utilized to ignite the propellant in the canister 250. Combustion of the propellant raises the pressure within the gas generator assembly exerting a downward (downstream) force on the head 256. Initially, cooperation of the flange 260 with the second piece 244 resists the force. When the pressure within the gas generator reaches a gas generator release threshold pressure (e.g., about 500 psi (3.4 MPa) or, more broadly 400 psi (2.8 MPa) to 1000 psi (6.9 MPa)) and force applied to the head reaches an associated threshold force, the remainder of the head is sheared from the flange and driven downward to the open position of FIG. 9. This unseals a path portion 540 through the channel 252 from the canister 250 and out through the port 270 allowing the combustion gases to communicate with and pressurize the suppressant 203. The pressurization of the suppressant exerts an increasing pressure and force on the head 216. When this pressure exceeds a discharge threshold pressure such as that for the extinguisher 20 of FIG. 1, there will be a failure of the shaft 218 such as via a collapse or buckling, allowing the head 216 to be driven downstream to an open position such as shown in FIG. 9. A series of transverse pins 280 retain the head within the outlet chamber and prevent it from passing into or otherwise blocking flow to or through the nozzle 202. The combustion gas and suppression mixture then flows through the discharge head assembly along flow path portion 542.

To remanufacture the extinguisher 200, the gas generator assembly 240 is unscrewed from the bottle and discarded. The discharge head assembly may be similarly unscrewed or left in place. The plus 212 is unscrewed and the collapsed shaft 218 and head 216 removed. Although the head 216 may be reused, it may also be disposed of since it may have become damaged during the collapse of the shaft. The extinguisher is then preferably cleaned and a replacement head and replacement shaft inserted and the plug 212 screwed back into place. A replacement gas generator assembly 240 is screwed into place. A fill valve 282 mounted in a threaded transverse port in the body 206 upstream of the throat 228 is then utilized to first evacuate air from the extinguisher and then to refill the extinguisher with suppressant. An exemplary fill valve is described in United States Military Standard 28889-2. One benefit of the disposable gas generator assembly is that it is particularly effective for use of a relatively inexpensive squib such as are used as automobile airbag initiators in place of the more expensive milspec initiator. Examples of such initiators are the LCI initiator of Quantic Industries, Inc. of San Carlos, Calif. and products of Special Devices, Inc. of Newhall, Calif. These devices differ from the milspec initiator inter alia in that they may be much less expensive, typically having unthreaded plastic bodies.

Figure 10:
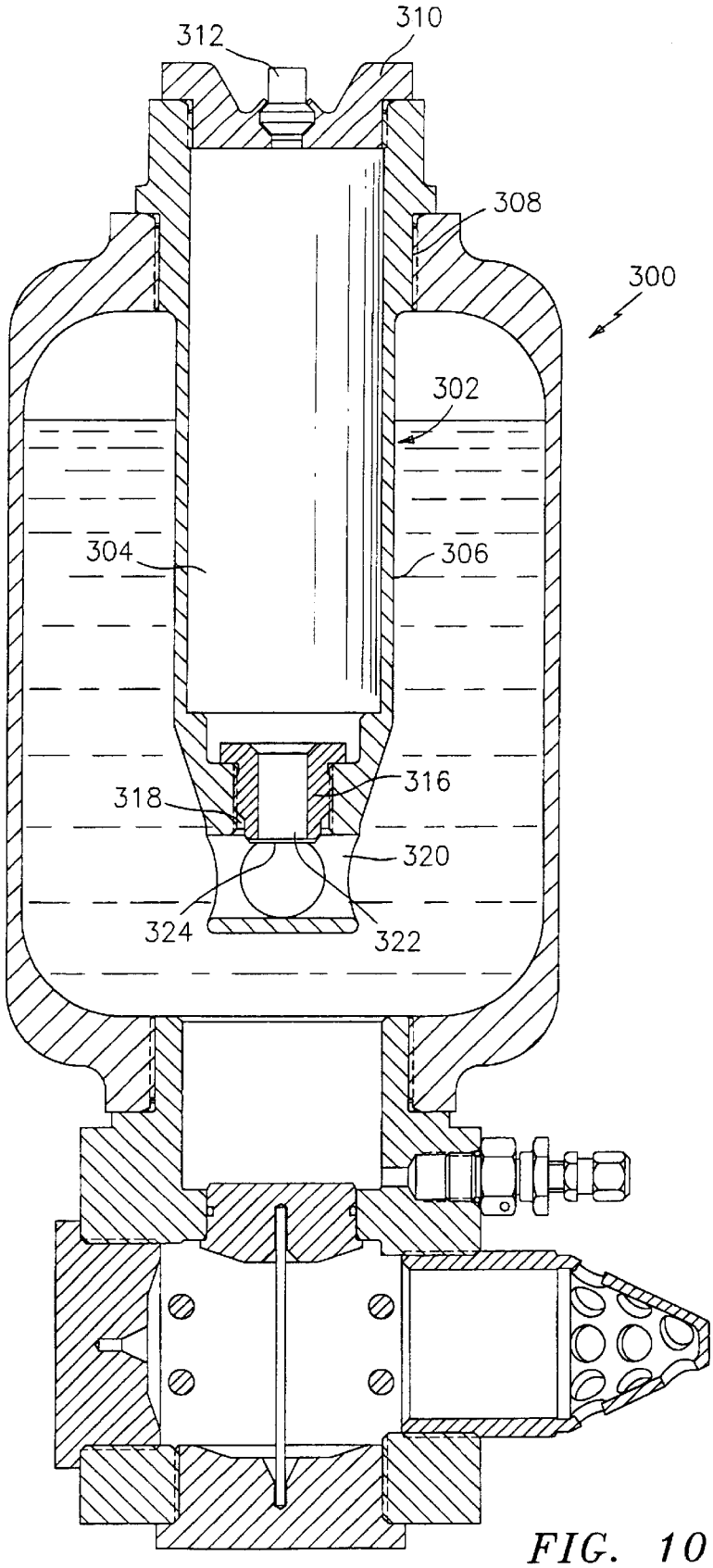
FIG. 10 is a longitudinal cross-sectional view of a third fire extinguisher according to principles of the invention.
Figure 12:
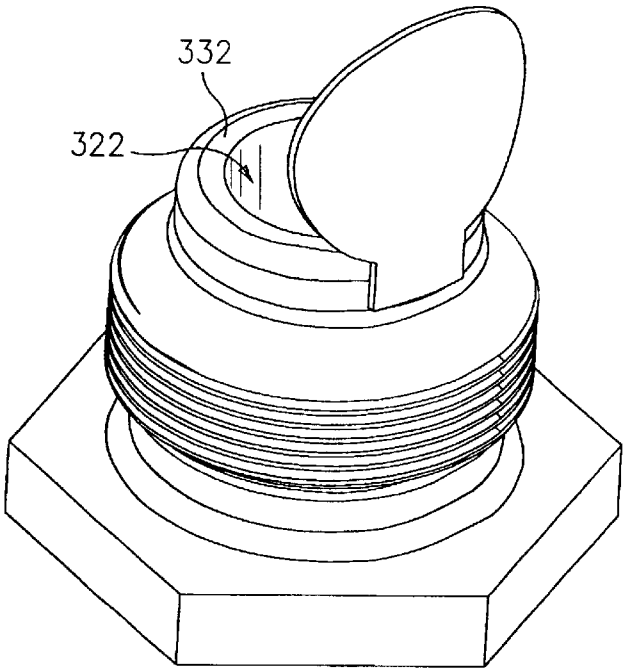
FIG. 12 is a view of the gas generator relief plug of FIG. 11 in an open condition.
Figure 11:
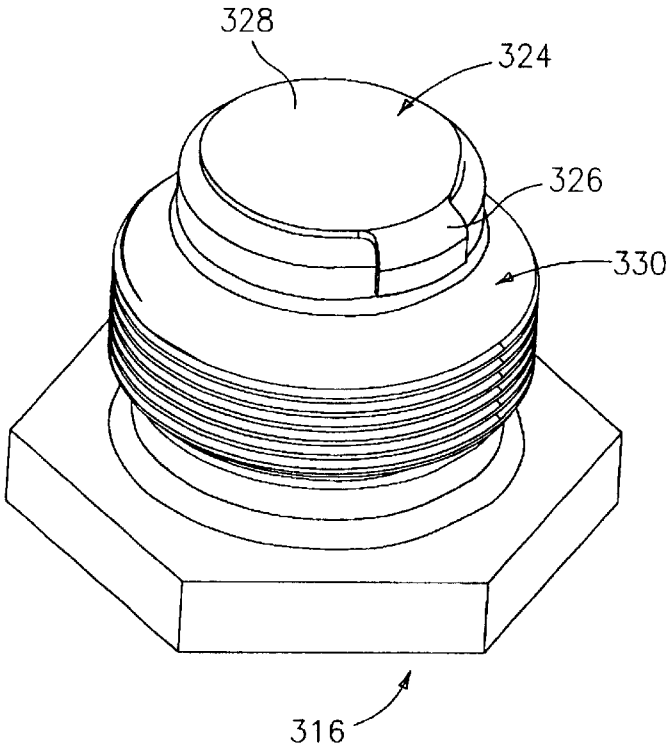
FIG. 11 is a view of a gas generator relief plug of the extinguisher of FIG. 10 in a closed condition.

FIG. 10 shows an embodiment of an extinguisher 300 which includes an alternate gas generator assembly 302. The other details of the extinguisher 300 may be similar to those of the extinguishers 20 and 200 or otherwise. The assembly 302 may use a propellant canister 304. A holder assembly for holding the canister includes a body 306 whose upper end includes an externally threaded portion 308 within the upper neck of the bottle. The open upper end of the body is sealed by an externally threaded closure 310 engaged to an internally threaded portion of the body and carrying a squib 312 in similar fashion to the squib 248 of the extinguisher 200. A lower surface of the closure 310 engages and retains an upper end of the canister 304 while a lower end of the canister is supported by an annular shoulder in the body 306. Below the lower end of the canister, the body is sealed by an externally threaded pressure relief plug 316 accommodated within an internally threaded throat 318 of the body. Below the throat 318 are a series of transverse outlet ports 320. The plug 316 includes a central longitudinal channel 322 extending from its flanged upper end to its lower end. The lower end is initially sealed by a cover 324. Exemplary material for the cover is a copper-nickel alloy, a nickel alloy, or brass. FIG. 11 shows further details of the exemplary plug 316. The cofer 324 is formed as a flap having a longitudinally-extending root portion 326 and a transversely extending web portion 328. The root portion 326 is relatively robustly secured to the body 330 of the plug, such as via a weld, braze, or robust solder joint. An exemplary material for the body is a low carbon steel, preferably plated for corrosion resistance or possibly copperized for improved solderability. The web 328 is relatively frangible secured to the body 330, such as via a solder or braze joint between the underside of the web and a rim 332 at the lower end of the body at the lower end of the plug (FIG. 12). Upon combustion of the propellant, the combustion gases within the cartridge holder exert pressure on the upstream surface of the web 328. When this pressure reaches a gas generator release pressure (e.g., about 500 psi (3.4 MPa) or, more broadly 400–1000 psi (2.8–6.9 MPa)), the pressure and force exerted on the web 328 is effective to rupture the relatively frangible joint allowing the flap to deform from its closed condition (FIG. 11) to its open condition (FIG. 12) while the robust joint prevents the flap from detaching. This unseals the path from the canister to the suppressant allowing the combustion gases to flow through the outlet ports 320 and cause discharge in a similar fashion to that which occurs in the extinguishers 20 and 200.

To remanufacture the extinguisher 300, the plug/closure 310 carrying the spent initiator is unscrewed and discarded. The spent propellant canister is removed and so is the spent gas generator relief plug 316 (such as via a use of socket wrench) and both are discarded. A new relief plug is screwed into place and a new canister inserted. A replacement closure carrying a replacement initiator is screwed into place. The discharge head assembly may be addressed and refilling attended to in similar fashion to the extinguisher 200. As with the other embodiments, the steps of manufacturing are exemplary and may be varied or added to.

In operation, the initiators must be electrically coupled to a power source. The initiators are preferably coupled to a control system which receives power from the vehicle's power bus. The control system may be microprocessor-based and may include one or more fire detection sensors (e.g., IR detectors). Upon detection of a fire condition, the control system triggers the initiator and thus discharge of the extinguisher. Optionally, but preferably, the control system may receive additional input from a vehicle occupant, such as via a switch, to trigger the initiator. The control system may include or be associated with one or more auxiliary power sources (e.g., battery back ups) in case of interruption of power from the vehicle power bus. Another option is to provide an independently powered triggering system in parallel with the control system. This additional system could provide manual actuation in case of a vehicle power failure. Examples are battery and switch arrangements, piezoelectric triggers, and the like.

Figure 13:
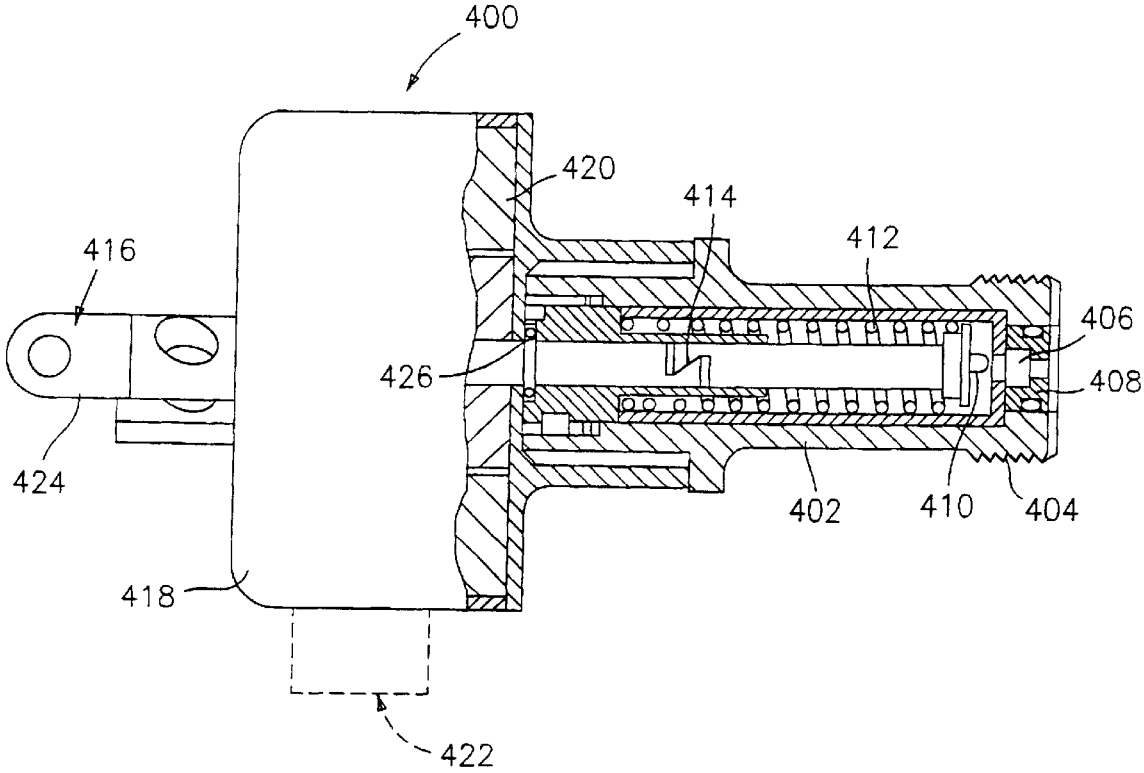
FIG. 13 is a partial longitudinal cross-sectional view of a percussion cap initiator.

Optional initiation systems may replace the squib-type initiators, for example, with a percussion cap primer system. One exemplary construction of means for triggering a percussion cap primer is seen in U.S. Navy Mechanical Actuated Initiator JAU-25 A which is utilized to initiate canopy jettison in an aircraft. In such a system, a handle or other actuator is used to draw back a spring-loaded actuation rod coupled by a sear to a firing pin. Release of the sear allows the firing pin to strike the primer, initiating the downstream explosive train. Such a system may be adapted for both manual and automated actuation of the extinguisher. FIG. 13 shows such an initiator 400 which may be utilized in place of a squib-type initiator such as that shown in FIG. 1. The initiator has a body 402 with a threaded downstream end 404 to allow the initiator to be removeably screwed into a propellant cartridge holder or the like. A cap-type percussion primer 406 is contained within a fixture 408 within the downstream end of the body. A firing pin 410 is biased by a spring 412 in a downstream direction (i.e., toward the primer). The firing pin 410 is coupled via a sear 414 to an actuation rod 416. A solenoid 418 is mounted at the upstream end of the body. The solenoid includes a coil 420 for which a central portion of the rod 416 serves as the associated plunger. An electrical connector 422 can couple the solenoid to the control system and a mechanical connector 424 on the actuation rod 416 can couple the actuation rod to a pull handle or other manual actuator. FIG. 13 shows an initial position of the actuator rod and firing pin wherein the spring 412 is under compression yet the firing pin is held spaced apart from the primer by cooperation of the actuation rod with a stop 426 fixed relative to the body. Either by energizing the coil via the control system or by manually pulling on the pull handle, the actuator rod may be drawn back (i.e., longitudinally away from the primer 406) from the initial position shown in FIG. 13. Initially, the drawing back of the actuator rod draws back the firing pin, further compressing the spring. Eventually, the rod will be drawn back to a position wherein the sear 414 releases, allowing the spring to drive the firing pin forward, independently of the actuation rod. No longer restrained by cooperation of the actuation rod with the stop, the firing pin proceeds beyond its initial position until it impacts the primer, causing ignition of the primer charge and, thereby, the propellant charge in the extinguisher.

Figure 14:
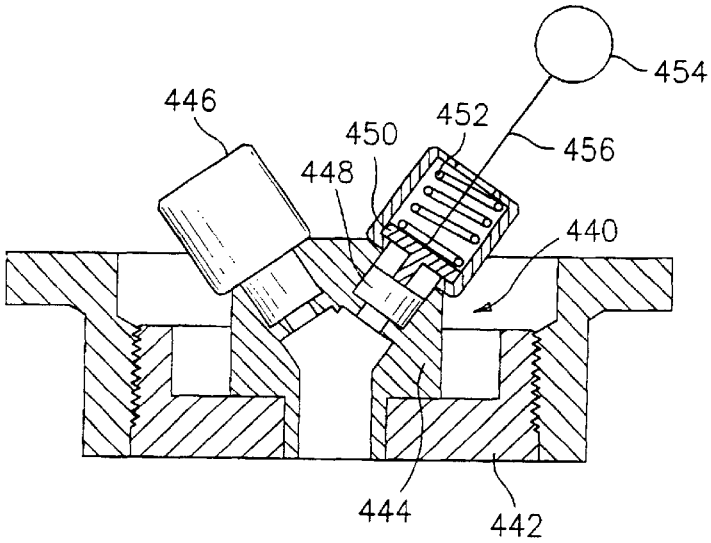
FIG. 14 is a partial longitudinal cross-sectional view of an initiation system utilizing a percussion cap and a squib.

Another system for providing both manual and automatic initiation of the extinguisher is shown more schematically in FIG. 14. An assembly 440 can be mounted within a cartridge holder assembly or, for example, a closure 442 thereof which may be similar to the closure/plug 66 of FIG. 1. A block or body 444 has a centrally apertured lower end threaded into the aperture of the plug and defines a y-shaped channel extending upward from the central aperture. One branch of the y receives a squib 446 while the other branch of the y receives a percussion primer-type initiation system such as one including a primer 448, firing pin 450, and spring 452 coupled to an actuator such as a pull ring 454 by a linkage such as a breakaway wire or a sear mechanism 456. The squib 446 (e.g., similar to the squib 74) is coupled to the control system for automatic actuation of the extinguisher while the pull ring 454 provides manual actuation. One or both of the squib and primer may be replaced in the remanufacturing of the extinguisher if such was utilized to initiate the propellant combustion.

One or more embodiments of the present invention have been described. Nevertheless, it will be understood that various modifications may be made without departing from the spirit and scope of the invention. For example, many of the features of the illustrated embodiments may be recombined to produce other embodiments or maybe adapted for use with a variety of existing extinguisher constructions, suppressants, propellants, and the like. Accordingly, other embodiments are within the scope of the following claims.

What is claimed is:

1. A fire extinguisher comprising:

a bottle having an interior;

a fire suppressant contained by the bottle when the extinguisher is in a pre-discharge condition;

a source of gas for pressurizing the suppressant at least when the bottle is in a discharging condition;

an outlet, through which the suppressant is discharged when the extinguisher is in the discharging condition; and a valve having a valve element having a closed position sealing the outlet and an open position permitting discharge of the suppressant through the outlet, the valve element shiftable from the closed position to the open position responsive to a pressure within the bottle exceeding a discharge threshold pressure, whereupon the extinguisher enters the discharging condition and discharges the suppressant through the outlet, wherein:

the valve element comprises a poppet having:

a head; and a stem connected to the head, the head has a fore surface facing the bottle interior and an opposite aft face from which the stem extends along a poppet axis; and the valve comprises a locking element which in the pre-discharge condition has a first portion engaged to the poppet and a second portion held relative to the bottle and wherein in the pre-discharge condition the locking element transmits force to the poppet which retains the poppet in the closed position and, responsive to the pressure within the bottle exceeding the discharge threshold pressure the locking element ruptures, whereupon the pressure within the bottle drives the poppet to the open position and the extinguisher enters the discharging condition.

2. The fire extinguisher of claim 1 further comprising a valve return spring biasing the poppet toward the closed position, which return spring is effective to return the poppet from the open position to the closed position when the fire suppressant has been substantially discharged from the extinguisher.

3. A fire extinguisher comprising:

a bottle having an interior;

a fire suppressant contained by the bottle when the extinguisher is in a pre-discharge condition;

a source of gas for pressurizing the suppressant at least when the bottle is in a discharging condition;

an outlet, through which the suppressant is discharged when the extinguisher is in the discharging condition; and a valve having a valve element having a closed position sealing the outlet and an open position permitting discharge of the suppressant through the outlet, the valve element shiftable from the closed position to the open position responsive to a pressure within the bottle exceeding a discharge threshold pressure, whereupon the extinguisher enters the discharging condition and discharges the suppressant through the outlet, wherein the valve element comprises:

a head having a fore face facing the bottle interior and an opposite aft face; and a collapsible shaft between the head and a valve body.

4. The fire extinguisher of claim 3 wherein in the pre-discharge condition, when the pressure within the bottle is lower than the discharge pressure, axial compression of the shaft is effective to resist rearward movement of the head and retain the head in the closed position and, responsive to the pressure within the bottle exceeding the discharge threshold pressure the shaft collapses via buckling, whereupon the pressure within the bottle drives the head to the open position and the extinguisher enters the discharging condition.

5. A fire extinguisher comprising:

a bottle extending from a first end to a second end, opposite the first end, the bottle having a failure pressure;

a fire suppressant contained by the bottle when the extinguisher is in a pre-discharge condition;

a source of gas for pressurizing the suppressant at least when the bottle is in a discharging condition; and an outlet, through which the suppressant is discharged when the extinguisher is in the discharging condition;

a poppet having:

a head; and a stem connected to the head, wherein the head has a fore face and an opposite aft face from which the stem extends along a poppet axis, the poppet having a closed position normally sealing the outlet and an open position permitting discharge of the suppressant through the outlet and wherein the head has a preferential rupture zone which, upon an internal pressure in the extinguisher exceeding a safety threshold pressure ruptures so as to permit discharge of suppressant from the extinguisher, reducing the internal pressure and preventing the internal pressure from rising to within a safety margin of said rupture pressure.

6. The fire extinguisher of claim 5 wherein:

the preferential rupture zone is proximate an annular groove in the head so that upon such rupture an annular peripheral portion of the head detaches from a core portion of the head.

7. The fire extinguisher of claim 6 wherein:

the fore face of the head faces the bottle interior;

the source of gas comprises a chemical propellant charge which, upon ignition elevates the internal pressure; and in normal operation the poppet is shiftable from the closed position to the open position responsive to the pressure within the bottle exceeding a discharge threshold pressure, less than said safety threshold pressure, whereupon the extinguisher enters the discharging condition and discharges the suppressant through the outlet.

8. The fire extinguisher of claim 7 wherein the safety threshold pressure is between about 1000 psi and about 2000 psi and the discharge threshold pressure is between about 300 psi and about 1500 psi.

9. The fire extinguisher of claim 5 wherein the safety threshold pressure is between about 1000 psi and about 3000 psi.

10. A fire extinguisher comprising:

a bottle having an interior;

a fire suppressant contained by the bottle when the extinguisher is in a pre-discharge condition;

a replaceable cartridge containing a chemical propellant charge; and a cartridge holder assembly for holding the cartridge and having:

a first end mounted within an aperture at an upper end of the bottle;

a second end immersed within the suppressant when the extinguisher is in the pre-discharge condition;

a closure, closing the first end;

a squib mounted within the closure for igniting the propellant; and a gas generator relief plug initially sealing a path between the cartridge and the suppressant and comprising:

a centrally apertured metal body; and a metal flap member initially secured to the metal body at least in part by a joint which is selected from the group consisting of a braze and a solder joint;

wherein, upon combustion of the propellant, pressure applied to the flap by combustion gasses emitted by the propellant is effective to rupture the joint so as to allow the flap to assume a position wherein such path is unsealed and the combustion gasses may communicate with and pressurize the suppressant; and an outlet, through which the suppressant is discharged responsive to the pressurization of the suppressant.

11. The fire extinguisher of claim 10 wherein prior to combustion of the propellant the flap has a first transversely extending portion secured by said joint to the body and a second longitudinally extending portion secured to the body by a second joint, which second joint which is selected from the group consisting of a braze, a weld, and a solder joint.

12. A fire extinguisher comprising:

a bottle having an interior;

a fire suppressant contained by the bottle when the extinguisher is in a pre-discharge condition; and a gas generator assembly having:

a chemical propellant charge;

a body having at least one piece and having:

a first end mounted within an aperture at an upper end of the bottle;

a second end immersed within the suppressant when the extinguisher is in the pre-discharge condition;

an initiator for igniting the propellant; and a gas generator relief poppet initially sealing a path between the propellant and the suppressant and comprising:

a head having a fore surface facing the propellant and an aft surface and having a perimeter portion engaged to the body; and a stem extending aft from the head;

wherein, upon combustion of the propellant, pressure applied to the head by combustion gasses emitted by the propellant is effective to rupture the head so as to separate a remainder of the gas generator relief poppet from the perimeter portion and allow the remainder to assume a position wherein such path is unsealed and the combustion gasses may communicate with and pressurize the suppressant; and an outlet, through which the suppressant is discharged responsive to the pressurization of the suppressant.

13. The fire extinguisher of claim 12 wherein in said pre-discharge condition movement of the discharge poppet toward the propellant is prevented by interaction of a protuberance at a distal end of the stem with the gas generator assembly body about an aperture through which the stem passes.

14. A fire extinguisher comprising:

a bottle having an interior;

a fire suppressant contained by the bottle when the extinguisher is in a pre-discharge condition;

a replaceable cartridge containing a chemical propellant charge; and a cartridge holder assembly for holding the cartridge and having:

a first end mounted within an aperture at an upper end of the bottle;

a second end immersed within the suppressant when the extinguisher is in the pre-discharge condition;

a closure, closing the first end; and an initiator assembly mounted within the closure for igniting the propellant and comprising:

a body;

a replaceable percussion cap primer having a primer charge;

a firing pin;

a spring; and a solenoid having:

a coil; and a plunge, coupled to the firing pin by a sear and shiftable, by energizing of the coil from a first position at least to a second position so that such a shift draws the firing pin away from the primer until the plunger reaches the second position, whereupon release of the sear allows the firing pin to be driven by the spring to impact the primer and cause ignition of the primer charge which in turn causes ignition of the chemical propellant charge so as to pressurize the suppressant and discharge the suppressant from the extinguisher.

15. The fire extinguisher of claim 14 further comprising a mechanism for manually shifting the plunger from the first position to the second position in the absence of energizing of the coil so as to provide a manual actuation of the extinguisher.

16. The fire extinguisher of claim 14 further comprising a control system for energizing the coil in response to: input from a fire sensor; and input from a manually actuatable switch providing manual actuation of the extinguisher.

17. A fire extinguisher comprising:

a bottle having an interior;

a fire suppressant contained by the bottle when the extinguisher is in a pre-discharge condition;

a chemical propellant charge; and a holder assembly for holding the chemical propellant charge and having:

a first end mounted within an aperture at an upper end of the bottle;

a second end immersed within the suppressant when the extinguisher is in the pre-discharge condition;

a closure, closing the first end; and an initiator assembly mounted within the closure for igniting the propellant and comprising:

triggering means for: (a) electrically triggering ignition of the propellant; and (b) mechanically triggering ignition of the propellant independent of electrical triggering, wherein said triggering means comprise:

a replaceable percussion cap primer having a primer charge;

a firing pin;

a spring;

a solenoid having:

a coil; and a plunger, coupled to the firing pin by a sear and shiftable, by energizing of the coil, from a first position at least to a second position so that such a shift draws the firing pin away from the primer until the plunger reaches the second position, whereupon release of the sear allows the firing pin to be driven by the spring to impact the primer and cause ignition of the primer charge so as to provide the electrical triggering; and a mechanism for manually shifting the plunger from the first position to the second position in the absence of energizing of the coil so as to provide the mechanical triggering.

18. A method for remanufacturing a discharged fire extinguisher, the discharged fire extinguisher including a spent propellant container and a discharge head assembly coupled to an extinguisher bottle, the method comprising:

removing the spent propellant container from the extinguisher bottle;

inserting a replacement propellant container into the extinguisher bottle;

removing a discharge valve head and a collapsed shaft from a body of the discharge head assembly;

replacing the discharge valve head and collapsed shaft with:

a replacement head having a fore face facing an interior of the extinguisher bottle and an opposite aft face, the replacement head being disposed in a port within the body of the discharge head assembly; and a replacement collapsible shaft, the replacement collapsible shaft supporting the replacement head within the port; and delivering a refill amount of fluid fire suppressant through a fill valve into the interior of the extinguisher bottle.

19. The method of claim 18 wherein:

the removal of the discharge valve head and the collapsed shaft from the discharge head assembly comprises:

unscrewing a discharge head end closure from an aperture of the body of the discharge head, the discharge head end closure having a socket initially accommodating an aft end of the collapsed shaft; and extracting the discharge valve head and the collapsed shaft through the aperture; and the replacing the discharge valve head and collapsed shaft comprises replacing the discharge head end closure so that the socket accommodates an aft end of the replacement collapsible shaft.

20. The method of claim 18 further comprising:

evacuating the bottle interior through the fill valve prior to delivering the refill amount of fluid fire suppressant.

* * * * *